US008701255B1

(12) United States Patent
Cavallaro

(10) Patent No.: US 8,701,255 B1
(45) Date of Patent: Apr. 22, 2014

(54) PROTECTIVE FABRIC

(71) Applicant: Paul V. Cavallaro, Raynham, MA (US)

(72) Inventor: Paul V. Cavallaro, Raynham, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/954,350

(22) Filed: Jul. 30, 2013

Related U.S. Application Data

(62) Division of application No. 12/380,863, filed on Mar. 4, 2009, now Pat. No. 8,555,472.

(51) Int. Cl.
*D03D 13/00* (2006.01)
*D03D 15/00* (2006.01)

(52) U.S. Cl.
USPC ..... 28/168; 28/169; 139/408

(58) Field of Classification Search
USPC ..... 28/168, 169, 170, 151, 178, 158, 172.1, 28/152, 165, 167; 2/2.5; 442/64; 428/911; 89/36.05; 427/331, 335, 352; 264/258; 139/408, 410, 411, 36, 409, 413, 414, 139/420 R, DIG. 1
See application file for complete search history.

(56) References Cited

U.S. PATENT DOCUMENTS 2,687,673 A * 8/1954 Boone ..... 359/489.16
2,807,072 A * 9/1957 Mersereau, Jr. ..... 428/92
2,918,160 A * 12/1959 Thompson, Jr. ..... 400/241.1
3,227,511 A * 1/1966 Seltzer ..... 8/183
3,369,957 A * 2/1968 Caroselli et al. ..... 428/196
3,713,875 A * 1/1973 Beyer et al. ..... 442/164
4,103,054 A * 7/1978 Okamoto et al. ..... 428/91
4,486,490 A * 12/1984 Patz et al. ..... 442/219
4,650,710 A * 3/1987 Harpell et al. ..... 442/135
4,681,792 A * 7/1987 Harpell et al. ..... 428/102
4,731,281 A * 3/1988 Fleischer et al. ..... 428/196
4,748,064 A * 5/1988 Harpell et al. ..... 428/113
5,087,499 A * 2/1992 Sullivan ..... 428/85
5,391,419 A * 2/1995 Davenport ..... 428/193
5,392,500 A * 2/1995 Olry et al. ..... 28/168
6,155,306 A * 12/2000 Katsukura et al. ..... 139/11
6,861,378 B2 * 3/2005 Cunningham et al. ..... 442/135
2002/0104576 A1 * 8/2002 Howland ..... 139/421
2002/0124904 A1 * 9/2002 Howland et al. ..... 139/420 R
2008/0017270 A1 * 1/2008 Newton et al. ..... 139/408
2010/0124862 A1 * 5/2010 Smith ..... 442/181
2010/0215953 A1 * 8/2010 Boussu et al. ..... 428/340

* cited by examiner

*Primary Examiner* — Amy Vanatta
(74) *Attorney, Agent, or Firm* — James M. Kasischke; Michael P. Stanley

(57) ABSTRACT

Crimp-imbalanced protective fabric is accomplished by varying the levels of yarn crimp within and across a layer or layers of a multi-layer fabric armor system. The method includes developing a crimp in the yarn (utilized for producing a fiber layer) by pulling the yarn through a solution that substantially coats the yarn. The removable coating has a thickness that ensures a proper amount of crimp in the yarn. The tension in the yarn is controlled; the yarn is weaved; and a crimp is applied in the yarn. Once the crimp is applied, families of the crimped yarn are utilized as a layer or layered to produce a soft armor form.

4 Claims, 33 Drawing Sheets

Plain Weave

PROTECTIVE FABRIC

This application is a divisional of and claims the benefit of prior patent application; U.S. patent application Ser. No. 12/380,863 filed on Mar. 4, 2009 and entitled "Crimp Imbalanced Protective Fabric" by the inventor, Paul V. Cavallaro. U.S. patent application Ser. No. 12/380,863 claims the benefit of U.S. Provisional Patent Application Ser. No. 60/070,262 filed on Mar. 21, 2008 and entitled "Crimp Imbalanced Protective Fabric Armor" by the inventor, Paul V. Cavallaro.

CROSS REFERENCE TO OTHER PATENT APPLICATIONS

None.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to protective fabric, and more particularly to a method for producing a crimp-imbalanced fiber for use as fabric components of soft protective armor.

(2) Description of the Prior Art

Crimped fabrics, such as a plain-woven construction example shown in FIG. 1, uniquely develop architectural changes on the meso-scale (yarn-to-yarn level) through crimp interchange as functions of biaxial tensions. Crimp interchange enables the tensile forces among yarn families to vary with applied multi-axial loading.

Crimp is typically defined as the waviness of a fiber in fabric form. Crimp interchange is the transfer of crimp content from one yarn direction to the other(s) as a consequence of fabric loading. Crimp interchange results from the relative motions of slip and rotation between yarn families at the yarn crossover points in response to applied loads. Crimp interchange is dependent upon the ratio of initial crimp content among yarn families and the ratio of stress between yarn families rather than the levels of stress. Crimp interchange, which is a coupling mechanism analogous to Poisson's effect in traditional materials, produces substantial nonlinearities in the constitutive behavior of woven fabrics.

FIG. 2 and FIG. 3 identify crimp-related parameters in geometric models for plain-woven fabrics constructed of yarns of circular cross sections. The two types of crimping shown in the figures describe two possible cases for a fabric. The parameters (recognizable to those ordinarily skilled in the art) for interpreting the use of the figures are: "d" is the yarn diameter (the same for the weft and warp yarns); "D" is the fabric thickness measured at cross-over points (overlap regions where the warp yarns cross the weft yarns); "p" is the distance between centers of adjacent yarns; "h" is the distance between centerlines of adjacent weft yarns (and h/2 is just one-half of h, also note that when h=0, there is no crimp in the weft yarns); "alpha" is the crimp angle of the warp yarns; and "L/2" is one quarter of the warp yarn's wave length shape (note that 4×L/2 equals one complete wave length of the warp yarn shape).

In the uni-directional crimp case depicted in FIG. 2, the yarns 2, 4 and 6 are not crimped. The yarns 2, 4 and 6 lie straight in the same horizontal plane and have zero waviness.

Yarn 10 is crimped (having waviness) to allow placement amongst the other yarns 2, 4 and 6. Therefore, this type of fabric construction is said to be uni-directionally crimped—only one yarn family 10 has crimp content (ie: waviness). The bi-directional crimping of FIG. 3 depicts that both yarns families; that is yarns 2, 4, 6 and 10 have waviness (note that the yarns 2, 4 and 6 do not lie within the same horizontal plane—see reference line 12).

The parameters of FIG. 3 are applicable for defining the geometric dependencies of crimp in fabrics constructed with tows (non-twisted yarns) of a nearly rectangular cross-section. Many ballistic fabrics employ non-circular cross section yarns such as rectangular, lenticular, elliptical, etc. Each type of yarn cross section provides slightly different sliding, interlocking, shearing and compaction compression at the cross-over points) characteristics at the points when the fabric is subject to extensional and shearing forces.

Crimp content is obtained by measuring the length of a yarn in a fabric state, $L_{fabric}$, and the length of the yarn after extraction from the fabric, $L_{yarn}$, and straightened out according to Equation (1).

$$C = \frac{L_{yarn} - L_{fabric}}{L_{fabric}} \tag{1}$$

There exists a limiting phenomenon to crimp interchange. As the biaxial tensile loads continually increase, a configuration results in which yarn kinematics (i.e.; slip at the cross-over points) cease and the interstices (spaces) between converge to minimum values. This configuration is referred to as the extensional jamming point. The jamming point can prevent a family of yarns from straightening thus limiting stresses in those yarns and in extreme cases can avert tensile failures. With the absence of failures in those yarns during a ballistic impact event, these yarns remain in position to provide a blunting mechanism that distributes the impact forces over a progressively larger number of yarns in subsequent fabric layers.

Research investigating ballistic impact mechanics of crimped fabrics have recognized the role of crimp interchange. Crimp interchange is often explored together with inter-yarn friction mechanisms because both involve sliding interfaces among yarn surfaces at the crossover points.

Research in woven ballistic fabric armor has produced findings that: (1) generally purport ranges of desirable friction coefficients for optimal ballistic protection performance measured in terms of a $V_{50}$ designation; (2) identify limiting bounds of these coefficients for use in numerical and analytical models and (3) establish the need for sizing methods to affect fiber roughness. Ballistic protection limits are designated by $V_{50}$, which is the velocity at which an armor panel of a given a real density has a 50% probability of stopping the projectile at zero degree obliquity.

Crimp effects in structural fabrics have also been researched. In the area of pneumatic structures, air beams were researched to establish the combined biaxial and shear behavior of plain-woven fabrics. Both meso-scale unit cell and fabric strip models were validated. The results indicated that crimp interchange, decrimping and shearing (also referred to as trellising—FIG. 4, FIG. 5 and FIG. 6) play major roles in the mechanical response of crimped fabrics subjected to applied structural forces. FIG. 4 depicts an unloaded state of woven fabric; FIG. 5 depicts a shearing (trellising) state of woven fabric and FIG. 6 depicts a shear jamming stage of woven fabric.

Shear trellising and shear jamming are the terms given to the configuration of a fabric subjected to pure shear. Consider the lower ends of the vertical yarns 20 clamped and the right ends of the horizontal yarn 22 clamped. Now, consider a horizontal force applied to the upper end of the vertical yarns 20. This is the shearing mode of loading that will cause the yarn rotations (trellising) and eventual yarn jamming states.

The advantageous effects of functionally graded crimping by design on soft fabric armor have not been sufficiently explored as a mechanism for increasing the combined ballistic and penetration protection levels as well as flexibility.

In the prior art, U.S. Pat. Nos. 6,720,277; 6,693,052; 6,548,430; 5,976,996; 5,837,623; and 5,565,264 of Howland relate to fabric substrates of woven constructions having principally two yarns, namely warp and fill (also referred to as weft), aligned in an orthogonal layout in accordance with a plain-woven architecture. These cited references claim a variation of crimp contents between the warp and weft yarn directions within a single layer but do not achieve the improved performances to: reduce regions of oblique susceptibility through the use of bias yarns; employ bias yarns in conjunction with woven fabrics; enable functionally graded protections against ballistic and/or stab penetration threats using crimp gradients in the through-thickness direction of multi-layered fabric system and reduce blunt trauma.

Furthermore, the cited references of Howland describe plain-woven fabrics possessing cover factors (CF) up to one hundred percent for warp fibers at the weft center and in excess of seventy-five percent for the weft. It has been defined in the art that a cover factor on the geometrical sense as the fraction of orthogonally projected fabric area that is occupied by yarns. As the cover factor increases so does penetration protection because the interstices between yarns decrease in size, which increases the resistance of the yarns to be pushed aside by sharp pointed penetrators.

Technology advances in soft fabric armor designs have focused on two principal construction methods (layered woven armor systems and uni-directional, cross-ply, layered armor systems). FIG. 7 depicts uni-directional layers arranged in multiple 0/90 degree stacks. During a ballistic impact, the uni-directional yarns dissipate the kinetic energy rapidly due to the absence of yarn crossover points. The crossover points in woven fabric armor reflect the shock waves rather than absorb the shock waves to a reduction of absorbed energies.

A disadvantage of uni-directional constructed fabric armor is the trade in comfort and flexibility for the incremental increase in ballistic protection. While this does not present a usability issue for vehicle and structural armor, it can be an issue for flexible body armor. This is because uni-directional fabric armors are not interlaced; that is, no yarn crossover points exist to enable the relative motions among yarn families that produce flexibility and conformity.

A need therefore exists for technological advances in fiber architecture and therefore an advance in soft fabric armor.

SUMMARY OF THE INVENTION

It is therefore a general purpose and primary object of the present invention to provide technological advances in fiber architecture and therefore an advance in soft fabric armor.

It is a further object of the present invention to provide a method for crimping a yarn for combined ballistic and penetration protection effectiveness in a resultant soft armor form.

In order to attain the objects described above, the present invention discloses methods for increasing the combined ballistic (including fragment) and penetration protection effectiveness of soft fabric armor for use in personnel clothing, vehicles, shelters, spall liners and other structural systems through modifications of the fabric architecture.

The present invention is accomplished by varying the levels of yarn crimp within and across a layer or layers of a multi-layer fabric armor system. The method includes developing a crimp in the yarn (utilized for producing a fiber layer) by pulling the yarn through a solution that substantially coats the yarn. The removable coating has a thickness that ensures a proper amount of crimp in the yarn. The tensions in the yarns are controlled; the yarns are woven; and crimp results in the yarn directions. Once the crimp is applied, families of the crimped yarn are utilized as a layer or layered to produce a soft armor form.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
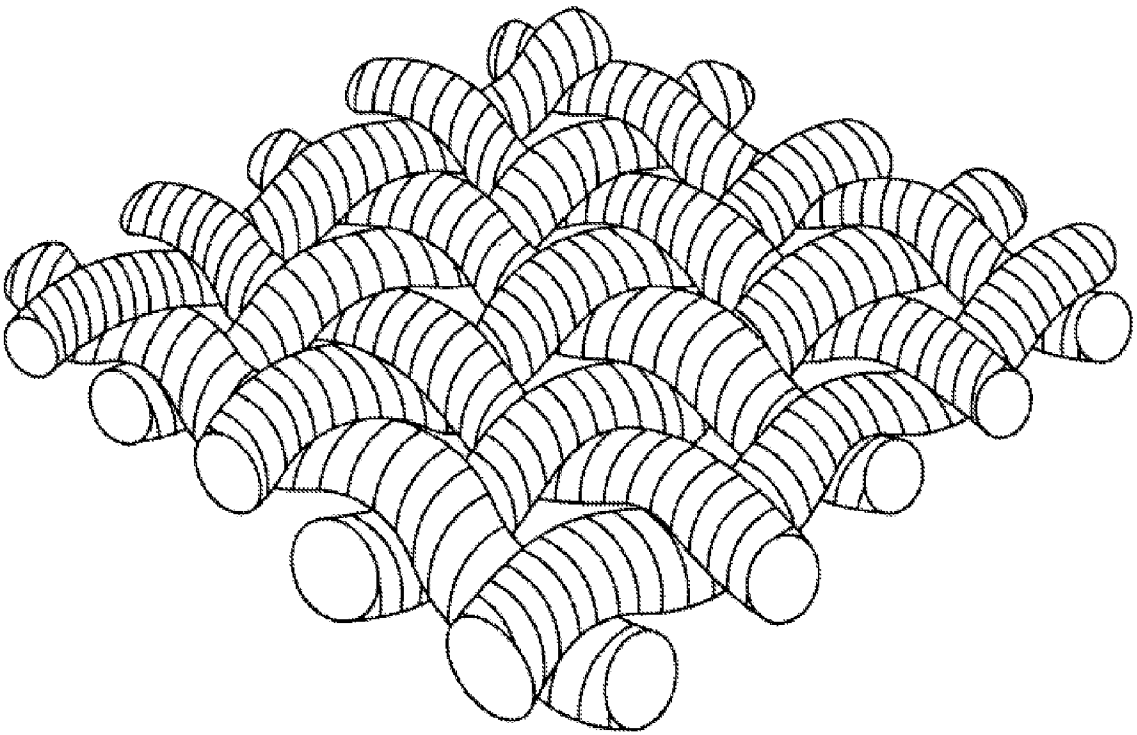
FIG. 1 (PRIOR ART)
FIG. 1 depicts a prior art example of a woven fabric layer.
Figure 2:
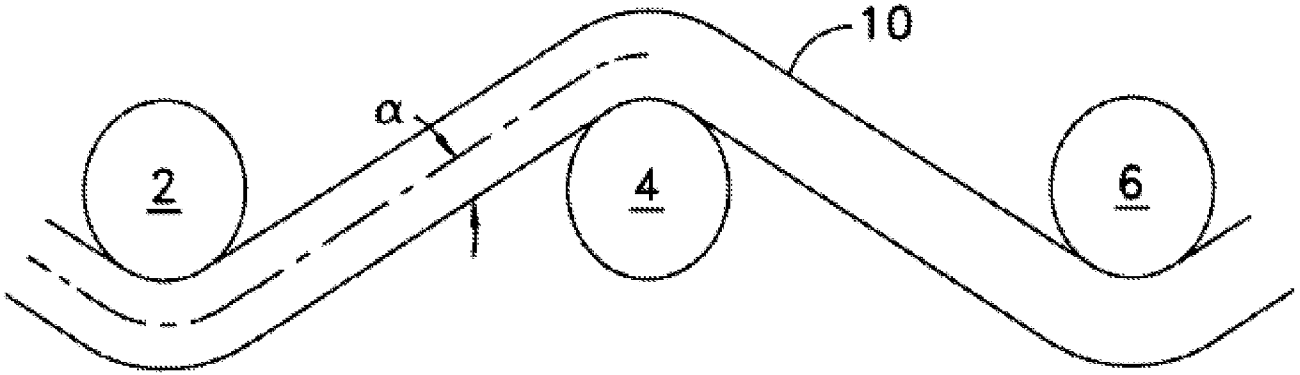
FIG. 2 (PRIOR ART)
FIG. 2 depicts a geometric model of prior art uni-directional crimping in plain-woven fabrics.
Figure 3:
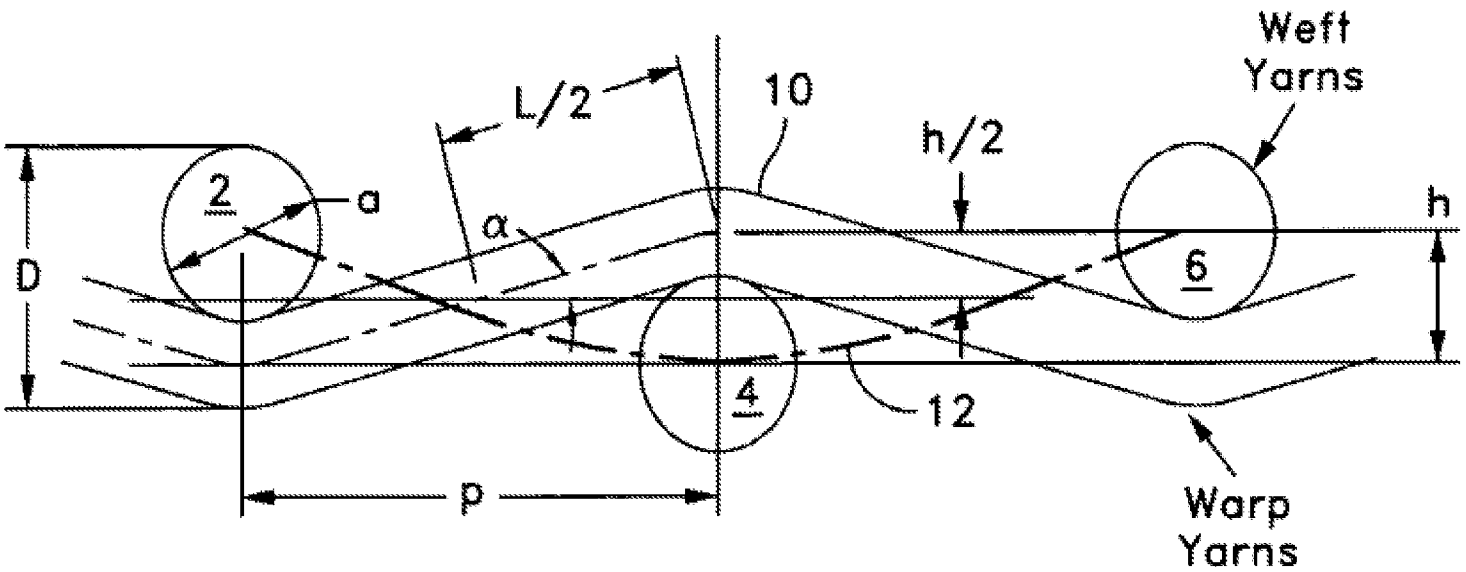
FIG. 3 (PRIOR ART)
FIG. 3 depicts a geometric model of prior art bi-directional crimping in plain-woven fabrics.
Figure 4:
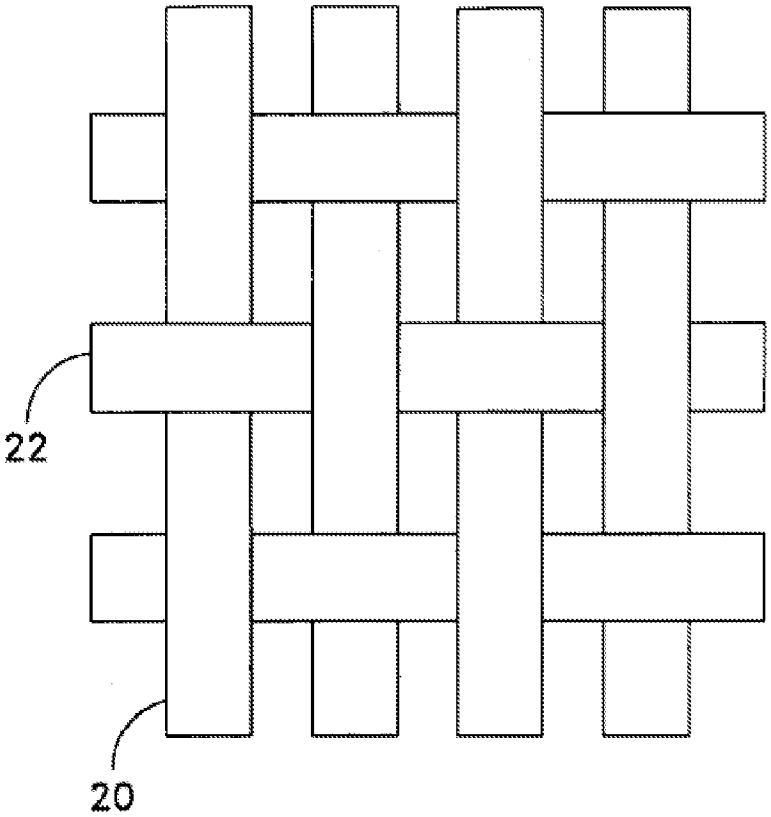
FIG. 4 (PRIOR ART)
FIG. 4 depicts a prior art unloaded state of woven fabric.
Figure 5:
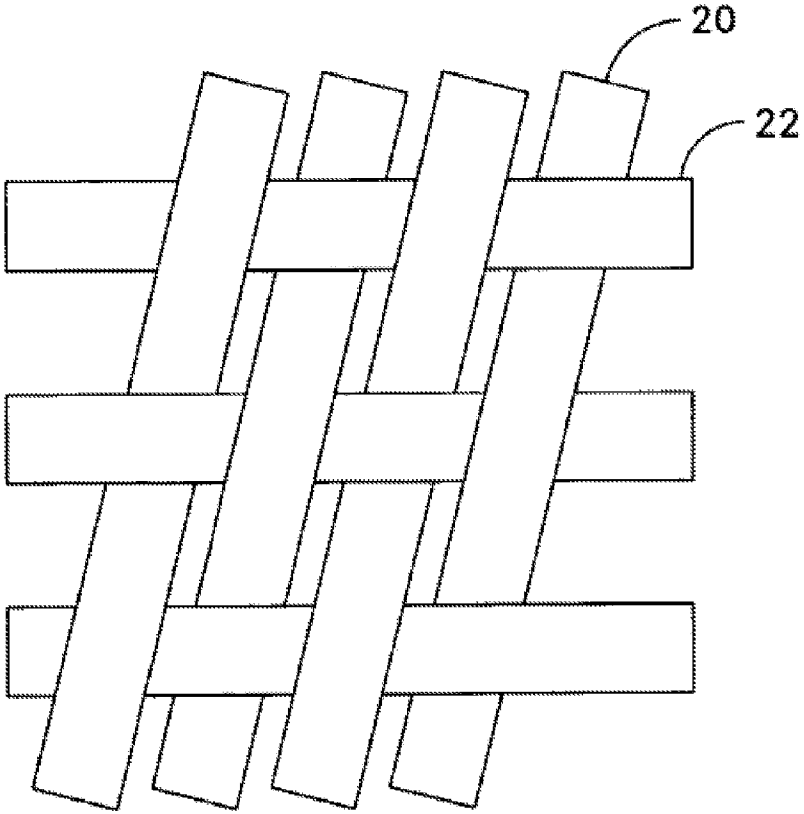
FIG. 5 (PRIOR ART)
FIG. 5 depicts a prior art shearing (trellising) stage of woven fabric.
Figure 6:
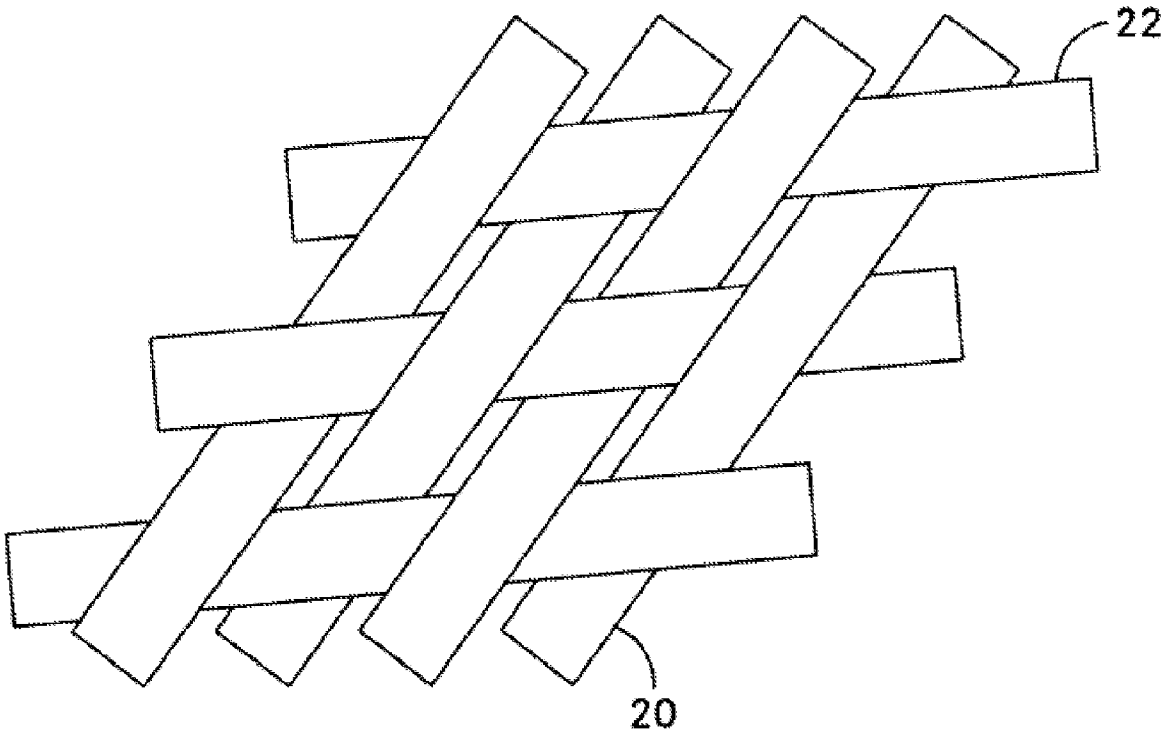
FIG. 6 (PRIOR ART)
FIG. 6 depicts a prior art shear jamming stage of woven fabric.
Figure 7:
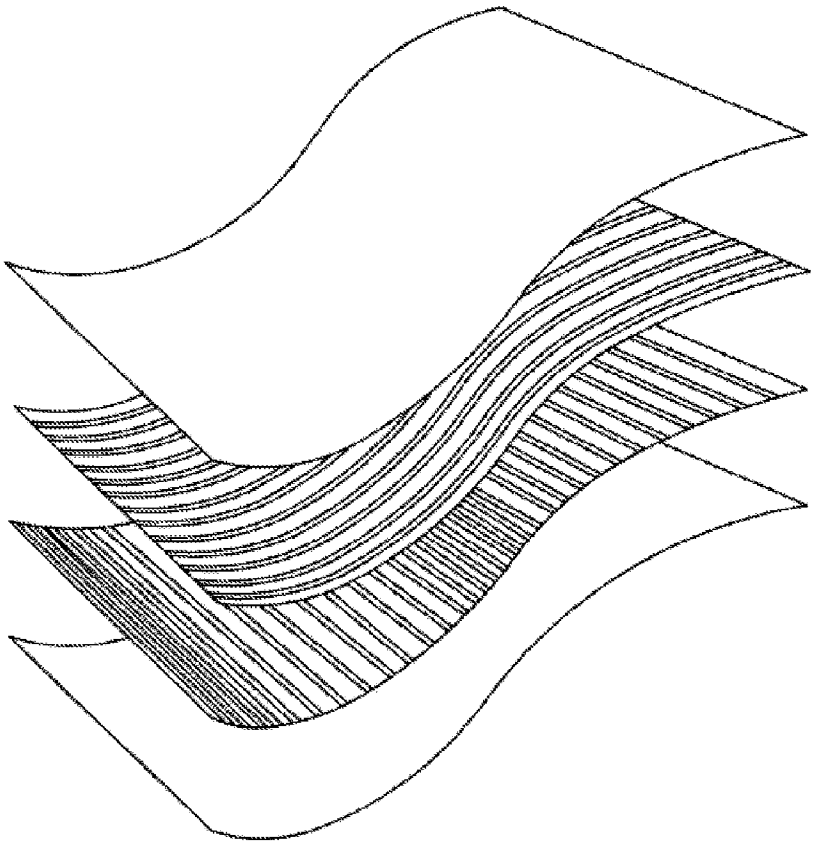
FIG. 7 (PRIOR ART)
FIG. 7 depicts a prior art non-woven cross-ply laminate.
Figure 8:
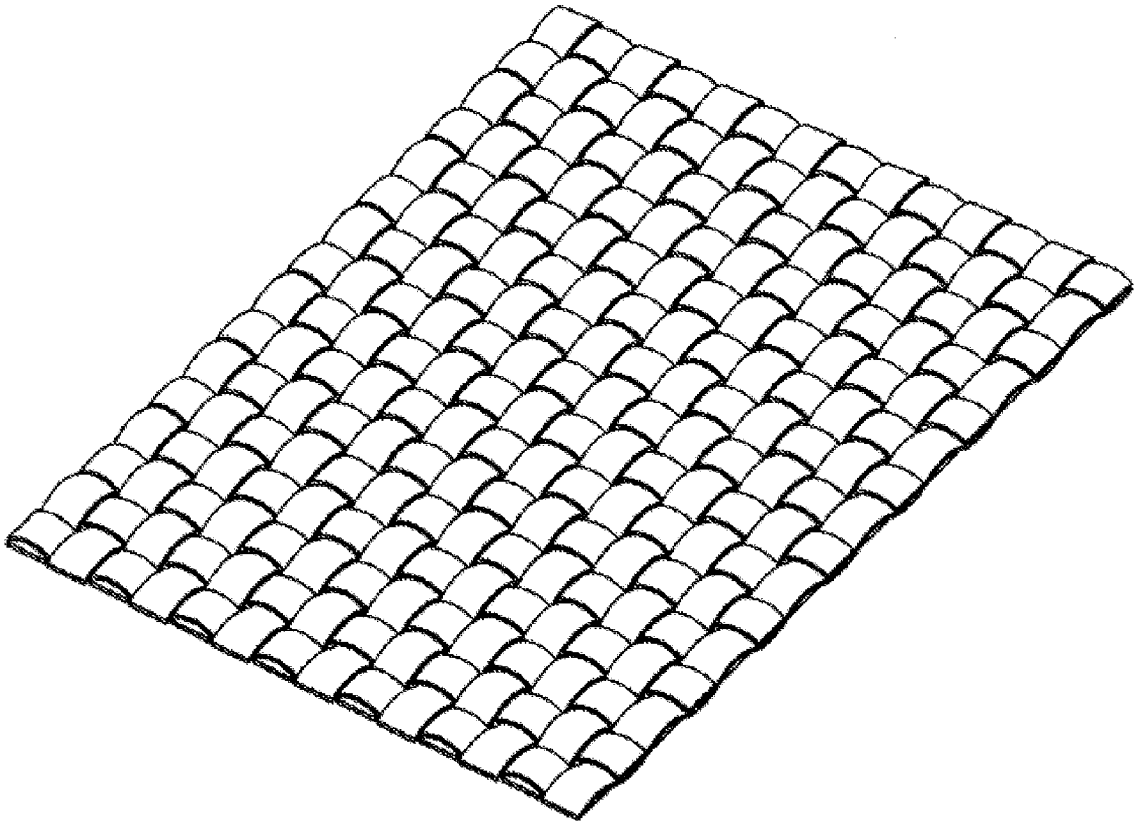
FIG. 8 (PRIOR ART)
FIG. 8 depicts a prior art example of balanced crimping in plain-woven fabric.
Figure 9:
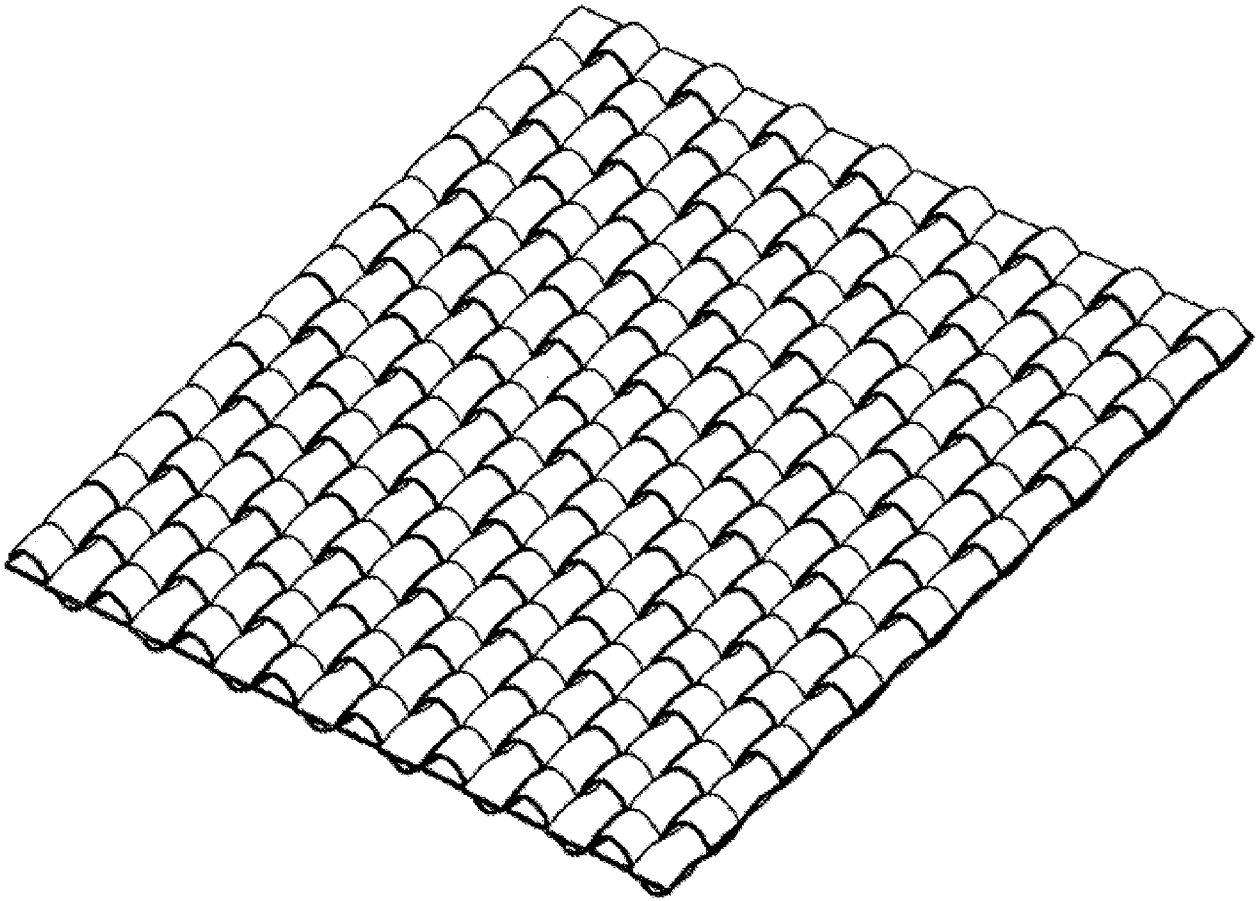
FIG. 9 depicts an example of unbalanced crimping in plain-woven fabric.
Figure 10:
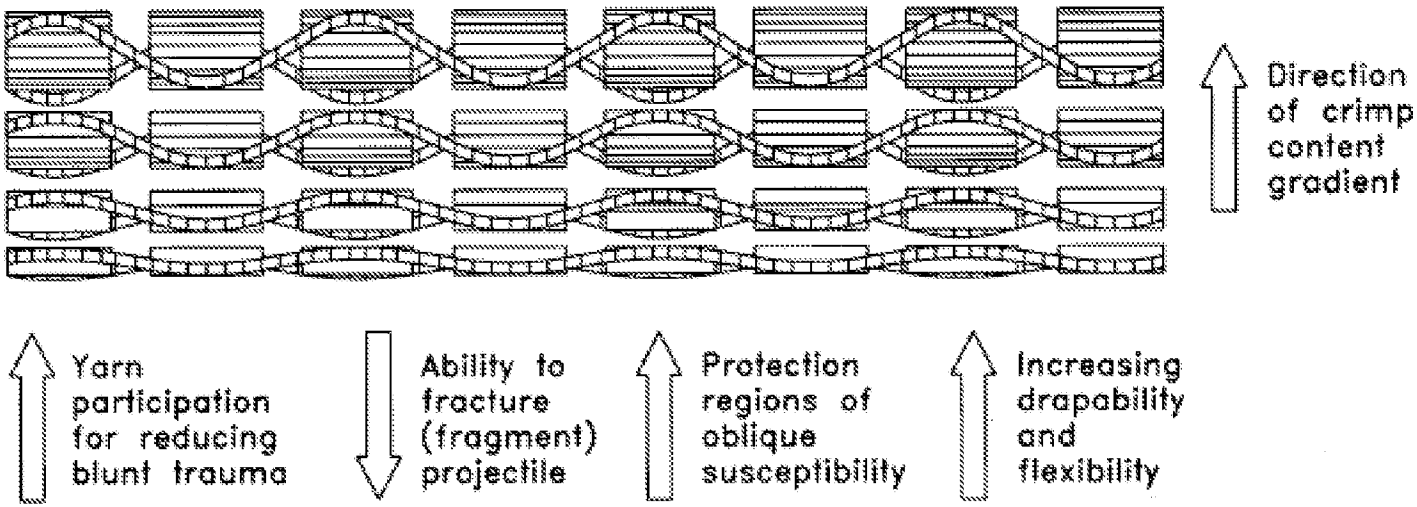
FIG. 10 depicts functionally-graded performances achieved through crimp variability for plain woven fabric.

The present invention is accomplished by varying the levels of yarn crimp within a layer and/or across layers of a multi-layer fabric armor system such that functionally-graded, improved protections can be achieved against ballistic and/or stab penetration threats. FIG. 8 is a prior art depiction of a fabric containing balanced crimp contents among yarn families in a plain-woven architecture while FIG. 9 depicts the inventive use of unbalanced crimp contents among yarn families in a plain-woven architecture. FIG. 10 demonstrates the graded performances as functions of crimp gradient for a multi-layered woven fabric system. Four layers are shown in FIG. 10; however, the multi-layer fabric may have even more numerous amounts of layers in individual crimp variants or sets of layers with similar crimp variants.

Figure 11:
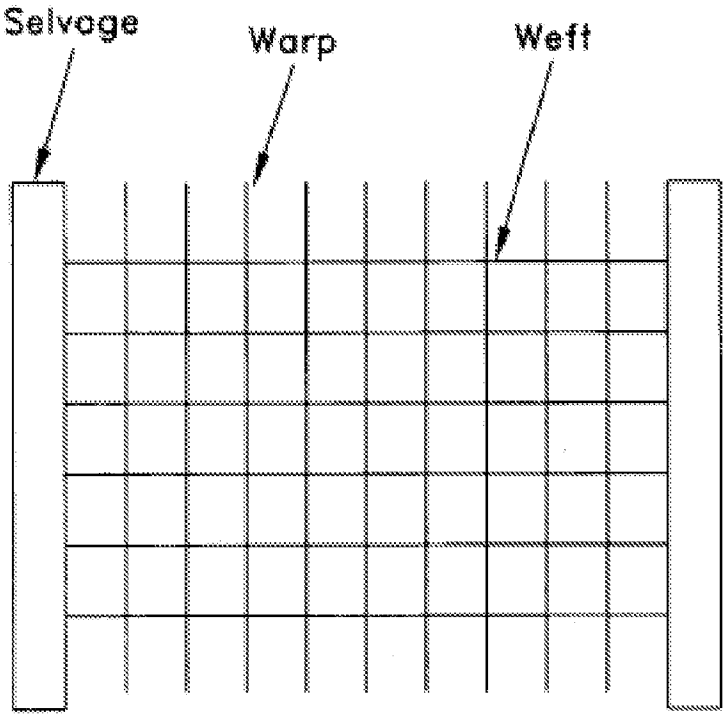
FIG. 11 (PRIOR ART)
FIG. 11 depicts a prior art example of plain weave fabric architecture.
Figure 12:
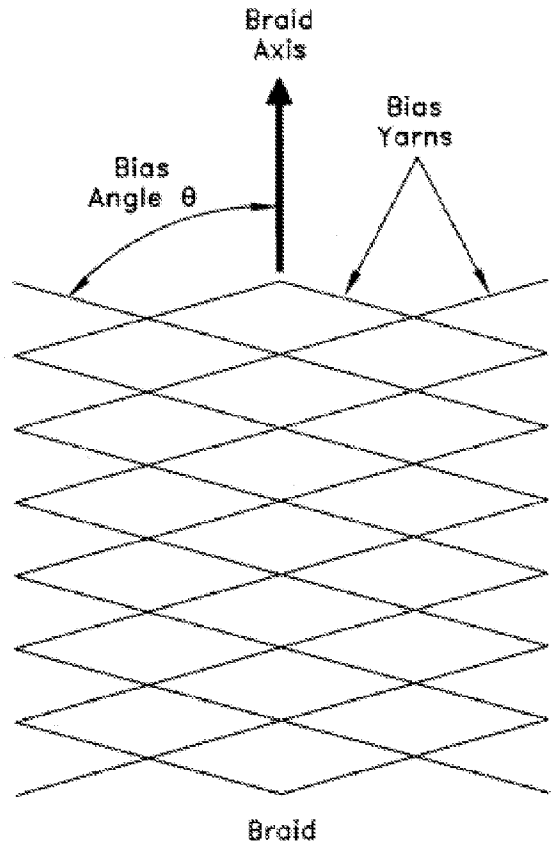
FIG. 12 (PRIOR ART)
FIG. 12 depicts a prior art example of braid fabric architecture.
Figure 13:
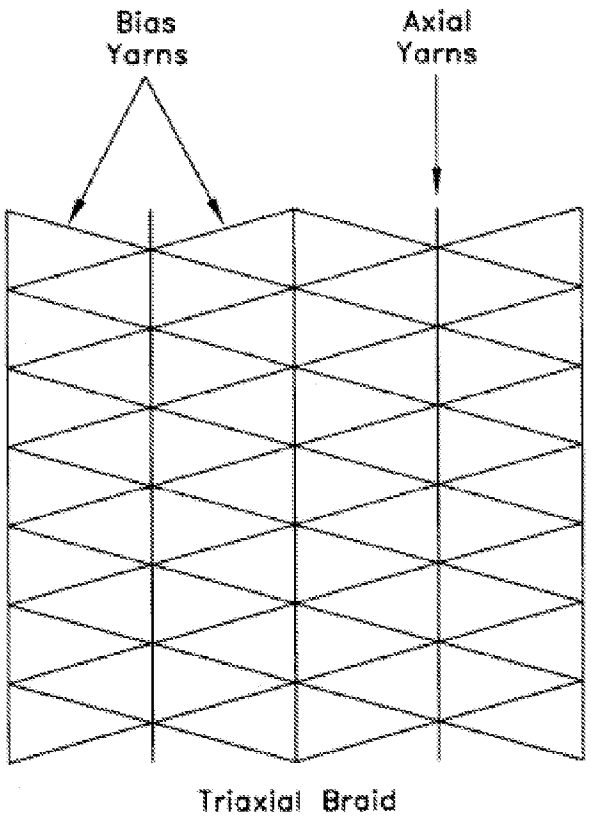
FIG. 13 (PRIOR ART)
FIG. 13 depicts a prior art example of triaxial fabric architecture.

The present invention also relates to crimped fabric architectures using fiber placement techniques such as woven (plain, harness, twill, satin, basket, leno, mock leno, etc.) or braided (biaxial, triaxial, quadraxial, etc.) as shown in prior art FIGS. 11-13. In relation to FIG. 12, a braid is formed when the yarns are at a non-orthogonal angle such as 30 or 60 degrees. A triaxial braid of FIG. 13 is a braid with the addition of one extra yarn family which is generally aligned along the 0-degree axis. The construction of these architectures may appear slightly different, their load-carrying capabilities and deformation shapes are significantly different. The crimped layers can be stacked in a variety of configurations along with non-woven fabrics layers and other materials (RHA steels, ceramics, etc.) to form hybrid constructions for specific applications and protection levels.

The variations of crimp within a fabric layer and along the through-thickness direction of the multi-layered fabric armor systems may be designed to: selectively control the levels of energy absorption and blunting performance within each layer; optimally tailor variable energy absorption and blunting performance levels (including projectile tumble) in the through-thickness direction; increase protection during fragmentation from obliquely dispersed fragments (particularly within regions of oblique susceptibility); decouple the arrival of peak stress waves between yarn families; minimize stress wave reflections at the yarn crossover points; deliver the performance benefits afforded by both crimped and uni-directional fabric armor systems combined with the maintained flexibility associated with crimped fabric systems; and integrate within vehicle, personnel, structural and inflatable systems.

Several instances of the present invention that utilize crimped fabrics are described by the following: a single crimped fabric layer having a minimum of two yarn axes generally disposed in non-orthogonal (i.e., biased) preferably braided directions with each yarn direction having different crimp contents; a multi-layered system comprised of iso-crimped fabric layers containing two yarn axes generally disposed in orthogonal preferably woven directions in which crimp contents are varied from one layer to another; a single, crimped fabric layer having a minimum of three yarn directions in which biased yarns are disposed in a non-orthogonal configuration to axial (warp) yarns (the bias yarns may be crimp-imbalanced with respect to the $C_{bias}>C_{axial}$); a multi-layered fabric system in which there exists two or more crimped layers with at least one crimped layer containing a different number of yarn directions than another crimped layer(s) and a multi-layered fabric system in which there exists two or more crimped layers with at least one crimped layer containing at least one yarn direction having different crimp content than the same yarn direction of the crimped layer(s).

Figure 14:
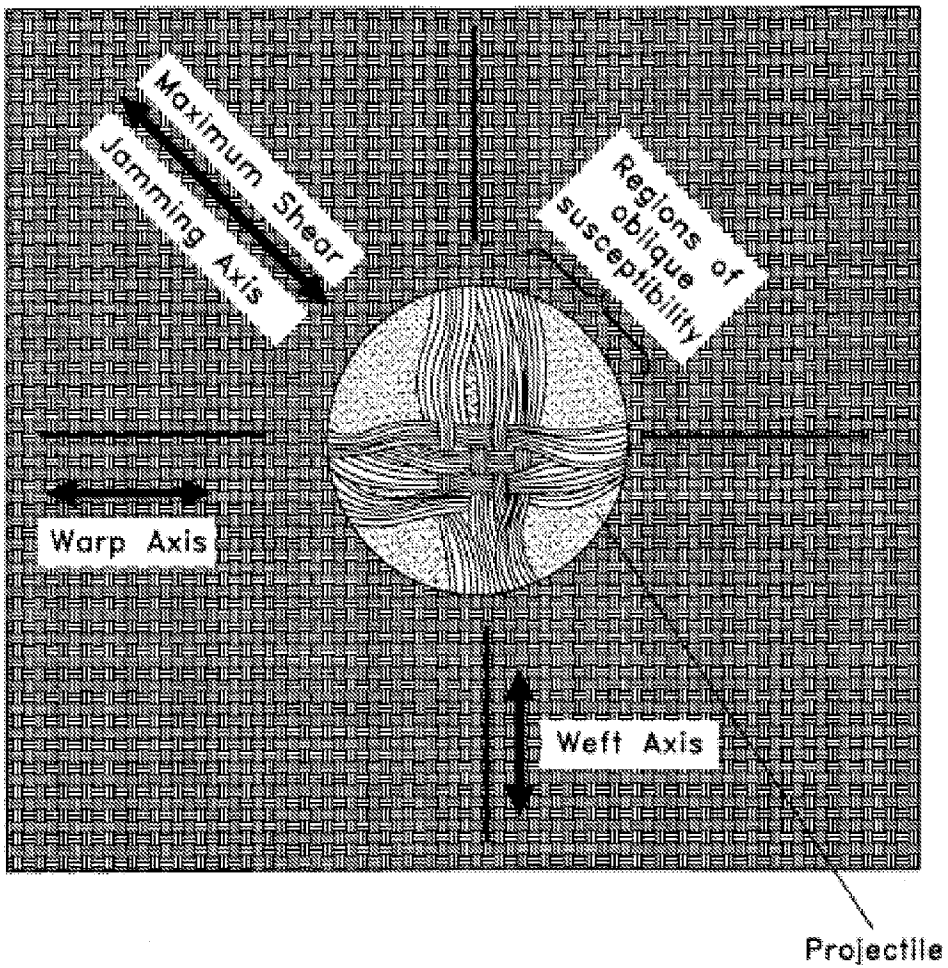
FIG. 14 is a prior art depiction of plain-woven fabric subjected to ballistic impact.
Figure 19:
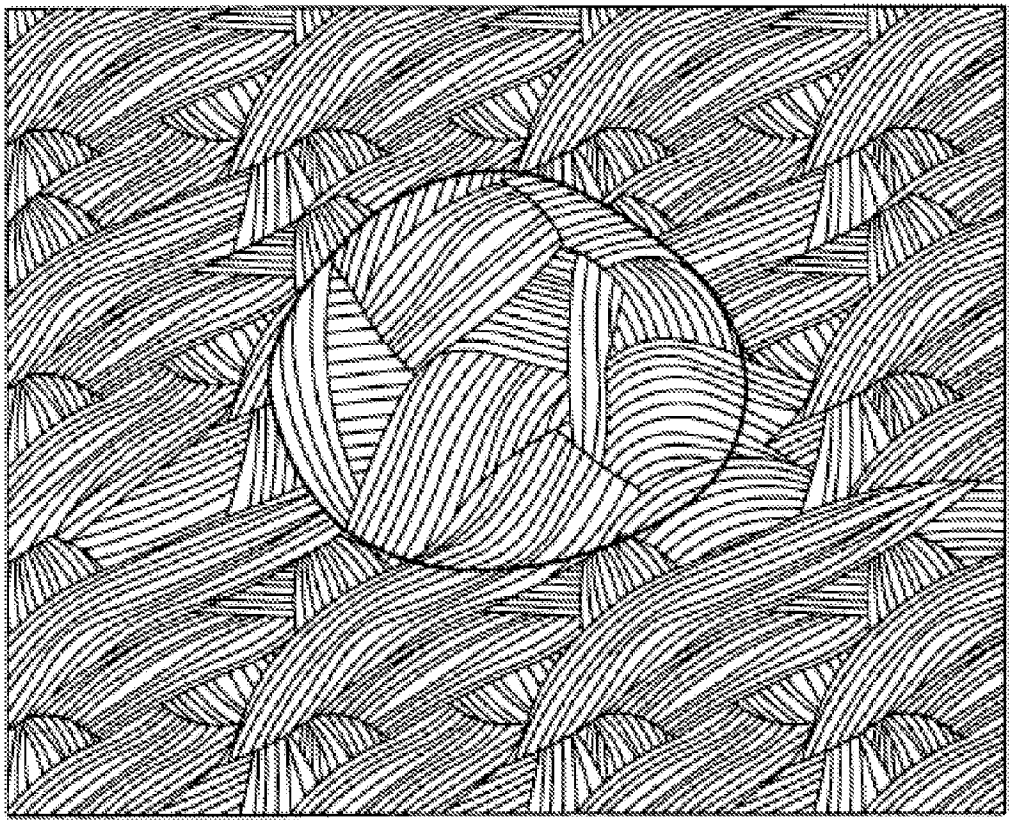
FIG. 19 depicts simulated ballistic impact deformation of a bi-plain triaxial fabric.

For example, consider a prior art iso-crimped plain-woven fabric (i.e. crimp ratio=$\xi_w=C_{weft}/C_{warp}=1.0$) constructed with equal warp and weft counts per inch as shown in FIG. 14. The figure depicts a plain-woven fabric with equal crimp contents among the warp and weft yarns. During ballistic impact, the warp and weft yarns at a given crossover point will develop nearly identical tensions. When these tensions exceed the failure threshold, both yarns will fail simultaneously allowing potentially further penetrating into subsequent fabric layers. (See FIG. 19 for a comparison in relation to FIG. 14).

The presence of bias yarns having a preferably higher crimp content (HCC) in comparison to lower crimp content (LCC) orthogonally arranged yarns can: delay/eliminate yarn failures thus providing continued protection in the regions of oblique susceptibility; minimize trellising deformations; recruit a greater number of yarns to arrest projectile motion; reduce blunt trauma by distributing the impact forces over a greater number of yarns and subsequent layers and provide greater protection against penetration through subsequent layers.

Consider a triaxial braid architecture containing HCC bias yarns and LCC axial yarns subjected to ballistic impact. The LCC axial yarns will be subjected to higher tensions and will fail prior to the HCC bias yarns because the HCC yarns will be subjected to lesser tensions as the HCC yarns must straighten further before stretching. This ensures the continued presence of the HCC yarns to blunt the damage zone of the projectile.

Figure 15:
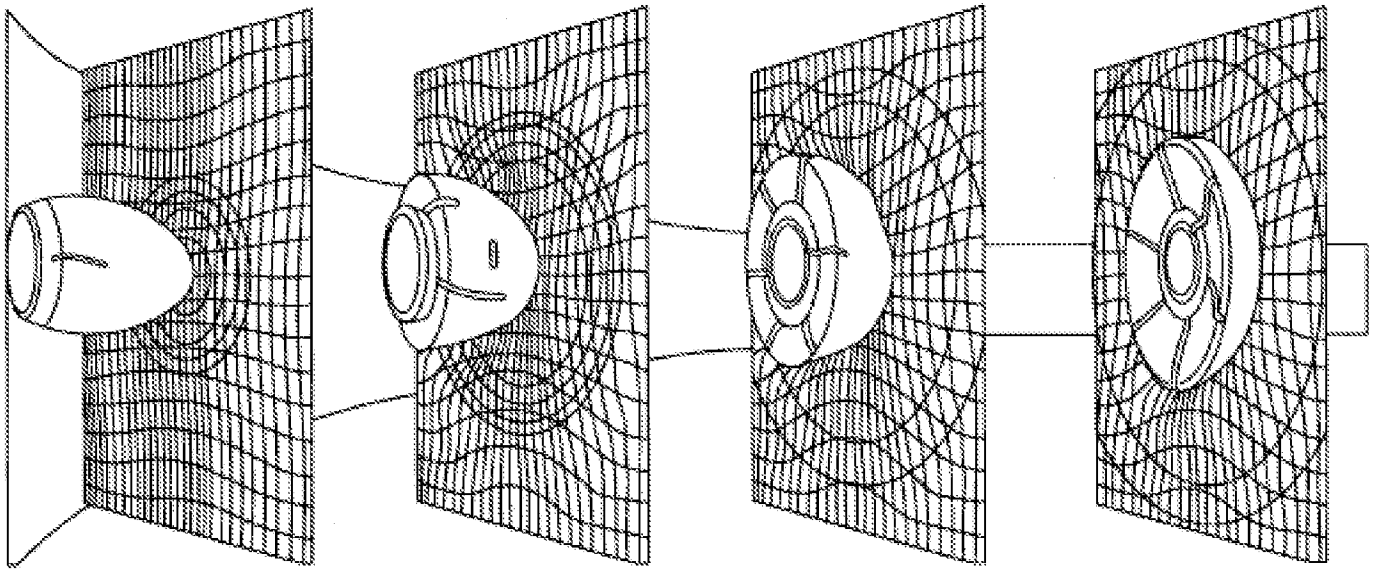
FIG. 15 depicts a formation of blunting deformations in a projectile.

Blunting can be considered as increasing a deformation of the projectile that occurs during the transfer of kinetic energy to the target surface as shown in FIG. 15. As depicted in the figure, progressive formation of tensile hoop cracks initiates blunting and fragmentation of the projectile. In a multi-layer system (similar to that shown in FIG. 10), the HCC bias yarns will distribute energy to multiple yarns of subsequent layers such that more yarns are actively engaged to absorb the residual kinetic energy. Zones of yarn engagement within each triaxial layer will be more circular-like and will possess increased radial uniformity than that found in woven fabrics.

Woven fabrics generally exhibit cross-like yarn engagement zones that are indicative of high anisotropic behavior. These cross regions typically extend beyond the radius of the yarn engagement zones for triaxial fabrics. This observation is critical to the multi-hit ballistic testing requirement for armor acceptance standards as overlapping damage zones can degrade ballistic performance of fabric armor systems.

As the remaining fabric layers begin to react, the blunting zone will progressively enlarge within the fabric plane by enlisting more crossing yarns of subsequent layers than is possible with woven fabrics. Therefore, the amplitude of lateral deformation, the cause of blunt trauma in personnel armor, may be reduced. The increasing blunting zone will engage more yarns on subsequent layers and will reduce the strains in those yarns because their radius of curvature within the impact zone will progressively increase along the direction towards the back face. Minimizing the effects of blunt trauma is especially important for body armor.

The stress wave behaviors for an iso-crimped versus crimped-imbalanced versus crimped-graded woven and bias fabric armors will differ. For example, consider an ideal iso-crimped woven fabric. Peak stress waves along each yarn family will occur simultaneously in time. However, for a crimp-imbalanced woven fabric, the lesser crimp content (LCC) yarns will experience their peak stress waves prior to that of the HCC yarns thus producing a time delay of shock effects between yarn families. This may positively affect the inter-yarn frictional behavior while separately increasing the absorbed energies within each yarn family. The LCC yarns will behave closer to uni-directional yarns by not "sensing" the presence of the crossover points. This is where traditional woven fabric armors suffer performance loss when considered against uni-directional (non-crimped) fabric armor. The crossover points, rather than absorbing the stress waves, reflect the shock waves back to the projectile impact location.

The blunting performance of crimp-imbalanced and crimp-graded fabrics (woven and biased) may be enhanced in comparison to iso-crimped woven fabrics. That is, the kinetic energy disperses in planes normal to the trajectory path with progressively increasing effected areas in the direction from the impact face toward the back face. Within a given layer, the LCC yarns absorb more impact energy while the HCC yarns blunt the impact zone to increase surface distribution from the front face layers through the back face layers. Failures of the HCC yarns, if the failures occur, are delayed in comparison to those of the LCC yarns. If the HCC yarns do not fail, the yarns may remain actively present providing increased blunting effectiveness not only within the region of maximum lateral deformation but especially within the periphery regions of the threat.

Figure 16:
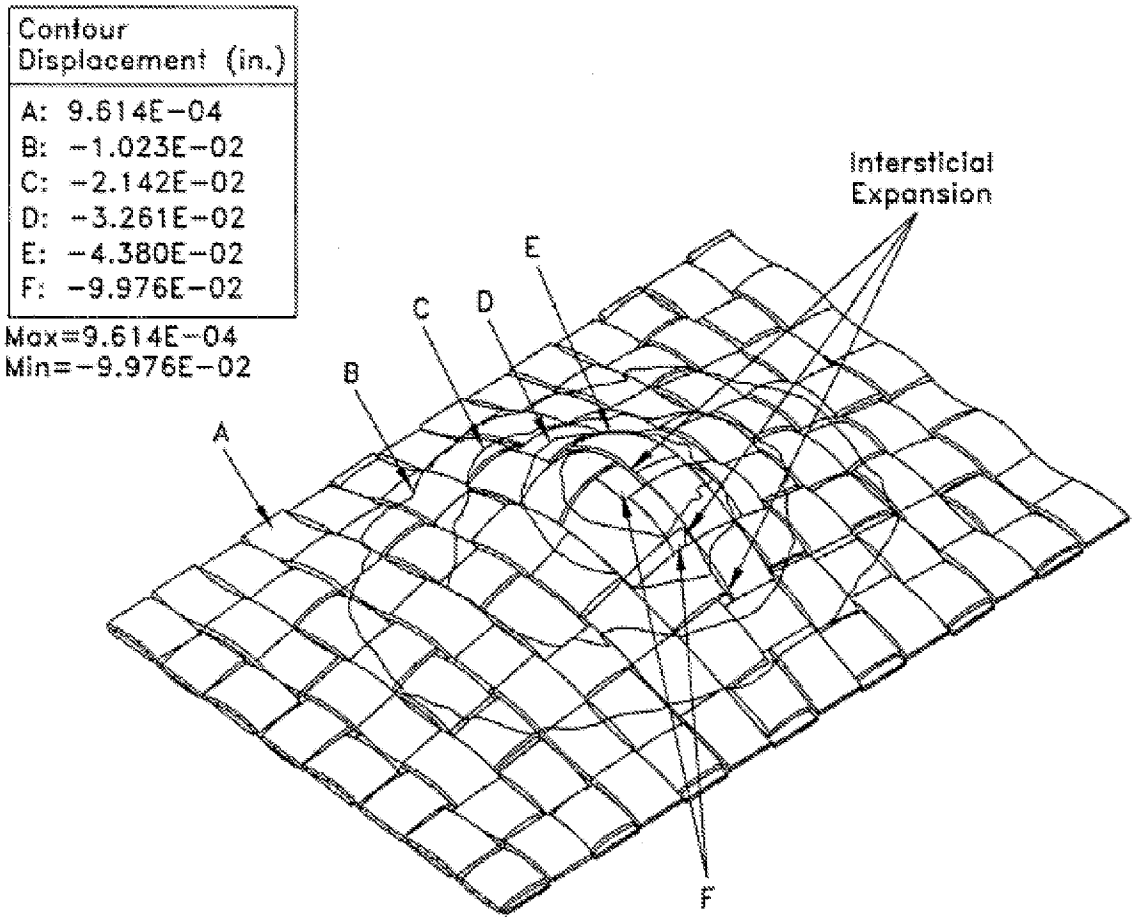
FIG. 16 depicts back face deformations exhibiting interstitial expansions.

Periphery regions are designated as regions of oblique susceptibility and are subjected to large trellising deformations because of the orthogonal alignment of yarn families. During the impact event, the interstices expand in size with increasing yarn trellising (as shown in FIG. 16). If fragmentation of the projectile occurs anywhere within the crimp-imbalanced and crimp-graded layers, the continued presence of HCC yarns (whether woven or bias) will enhance the protection against obliquely dispersed fragments. Furthermore, the shear-jamming angle can be reduced in the presence of bias yarns more than that of iso-crimped orthogonal fabrics. Because failure of the HCC yarns is delayed, the blunting effectiveness may be significantly enhanced within the regions of high shearing deformations.

The use of crimp-imbalanced and crimp-graded multi-layered fabrics provides potential cost-saving advantages. The HCC yarns can utilize cheaper, lower tenacity yarns than the LCC yarns. This is because the HCC yarns have an effective elongation consisting of yarn straightening (decrimping) following by yarning. Yarn straightening is kinematic-based (i.e., produces no strain) and yarn straining is constitutive-based (i.e., produces strain energy). The HCC yarns must be sufficiently straightened before strain can be developed. Therefore, these yarns can consist of lower tenacity, cheaper fibers such as S-glass and nylon 6-6 (ballistic grade nylon) in contrast to higher performance, more expensive fibers such as aramid fibers, liquid crystal polymer fibers and ultra high molecular weight polyethylene (UHMWPE) fibers. The resulting fabric would be considered a hybrid.

Similarly, if lower tenacity fibers have greater compressive and/or shear strengths than those of the exotic fibers, more energy dissipation can be achieved through the compression and/or shear. Furthermore, the cheaper, lower tenacity fibers may also be chosen for their improved environmental performance and maybe less susceptible to performance degradation resulting from exposure to moisture, aging, etc.

Figure 17:
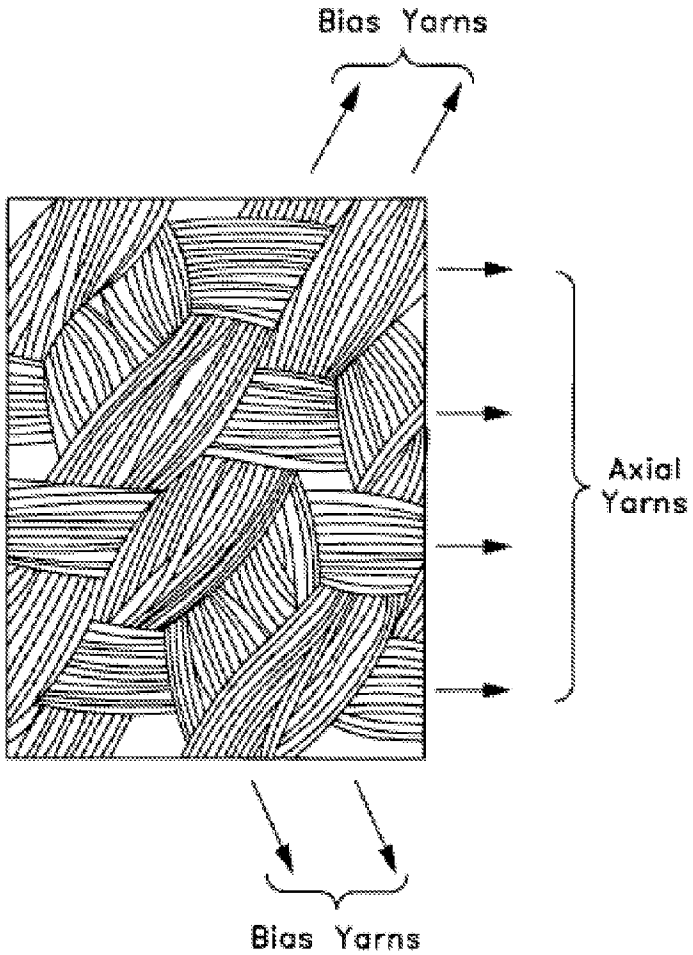
FIG. 17 depicts a bi-plain triaxial fabric.
Figure 18:
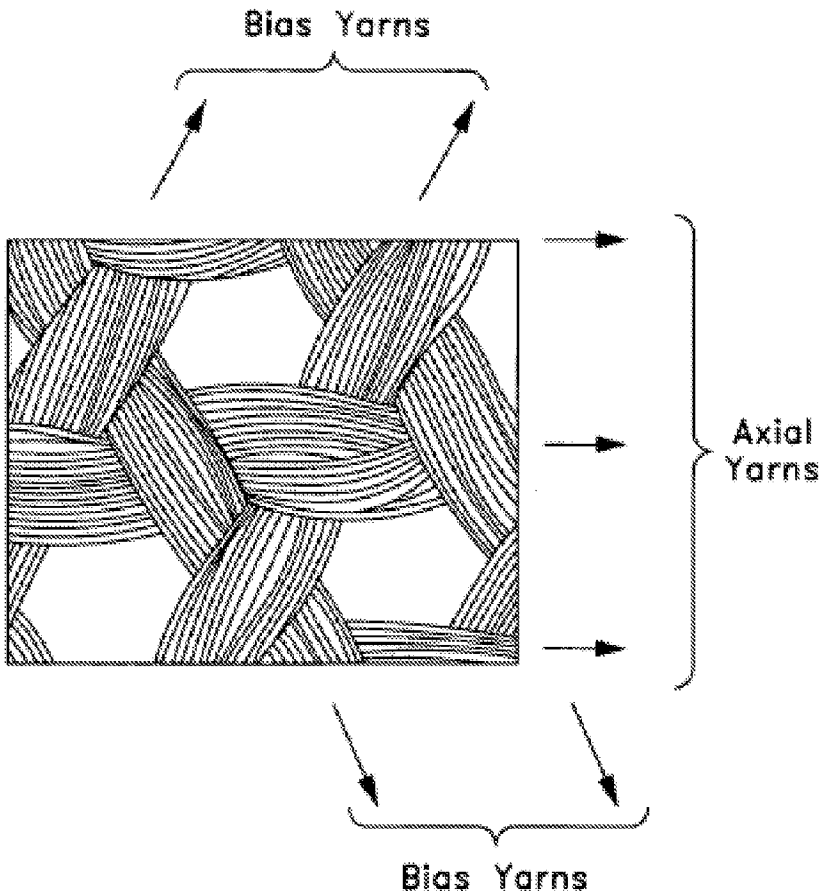
FIG. 18 (PRIOR ART)
FIG. 18 depicts a prior art triaxial fabric.

A modified triaxial braid that has cover factors similar to plain-woven fabric is a bi-plain triaxial fabric, shown in FIG. 17, which possesses a cover factor of ninety-six percent. A prior art triaxial fabric generally has a cover factor of sixty-seven percent and is shown in FIG. 18. However, cover factor alone does not completely describe the tightness of a fabric because crimp height is not considered.

The traditional and bi-plain triaxial architectures improve the isotropy (shear stiffnesses in particular) of the fabric when compared with woven architectures. The bi-plain triaxial architecture provides greater cover factors with increasing out-of-plane deformation (i.e., interstitial expansion is reduced) than does the woven architecture. The simulated ballistic impact deformation shown in FIG. 19 demonstrates the increased cover and decreased interstitial expansion achieved by the bi-plane triaxial fabric. The bias yarns clearly enhance the protective performance of the fabric against ballistic impact and stab penetration threats (See FIG. 14 for comparison regarding impact deformation).

The use of crimp-imbalance and crimp-grade constructions in multi-layered woven and bias fabric systems may provide an enhanced combination of ballistic (including fragment) and stab penetration protection mechanisms simultaneously with reduced blunt trauma. Previously, these protections required optimization of antagonistic fabric design parameters.

For example, low-density fabric constructions were required for ballistic protection whereby the kinetic energies were absorbed initially through relative yarn motions followed by conversion to yarn strain energy, acoustic energy, viscous dissipation, thermal energy, etc. Alternately, high-density fabric constructions prevented piercing of the fabric for stab protection by effectively minimizing the interstices between yarns. This prevented the yarns from displacing (sliding) away from sharp pointed objects thereby arresting penetration. The end result was an armor system that generally consisted of two separate armor sub assemblies—a loose fabric ballistic layer and a dense fabric stab protection layer. The result was a bulky, heavy and expensive armor system.

Crimp-imbalance and crimp-graded fabric armor can be manufactured in dense forms (in terms of yarn counts per inch) but can be engineered to provide the "loose" fabric performance characteristics required for ballistic protection. Furthermore, functionally graded multi-layered crimped fabrics can increase comfort factors (i.e., drape) and flexibility in contrast with iso-crimped multi-layered fabrics.

Key advantages over current crimped fabric armor systems are discussed here. First, regions of oblique susceptibility can be reduced in size by fifty percent or higher through the presence of bias (non-orthogonal) yarns in a single multi-layered fabric architecture containing all crimped layers or a mixture of crimped and non-woven layers.

Second, the inclusion of biased yarns reduces the shear-jamming angle of the fabric and stiffens the fabric in shear. The shear-jamming (or locking) angle is a geometric property resulting from the fabric construction. It is maximum change in angle that can occur between yarn families during trellising (shearing) deformations, such deformations lead to penetration within the regions of oblique susceptibility. As shear-jamming angles are limited to smaller values, the interstices existing between yarn cells reduce in size thus providing more penetration protection. Third, biased yarns having $C_{bias}>C_{axial}$ ensure that peak stress waves of the biased yarns are decoupled (delayed) in time from the iso-crimped warp and weft yarns. This minimizes reflections at the yarn cross-over points. Fourth, with $C_{bias}>C_{axial}$, the bias fibers serve to further blunt the projectile and distribute the impact forces over a greater number of yarns in subsequent layers.

Method of Manufacturing a Crimp-Imbalance

Specific crimp contents are produced during the weaving process along each yarn direction by controlling the tensions and/or weaving speeds for each yarn family. Methods for controlling the weaving speeds and yarn tensions are known to those ordinarily skilled in the art. Weaving looms are often set up with programmable tensioners to maintain prescribed settings used to ensure consistent weaving parameters. Yarn tensions and weaving speeds are dependent upon (but not limited to such factors as loom size, yarn diameter, yarn density, yarn elasticity, yarn bending stiffness and yarn thickness. Yarn bending stiffness directly affects the curvature of the yarns when woven into fabric form.

When such controls are not sufficient for achieving relatively large crimp contents, one alternative and the inventive approach of the present invention is to coat the yarns with a suitably thickened temporary coating. The temporary coatings can be wax (paraffin), latex (vinyl acetate, butadiene and acrylic monomers), plastic (poly vinyl chloride), cellulose, polyurethane, silicon and other coating materials known to those skilled in the art. Only one coating material would be necessary. Each of these coatings is removable, either through heat exposure or chemical exposure.

Figure 20:
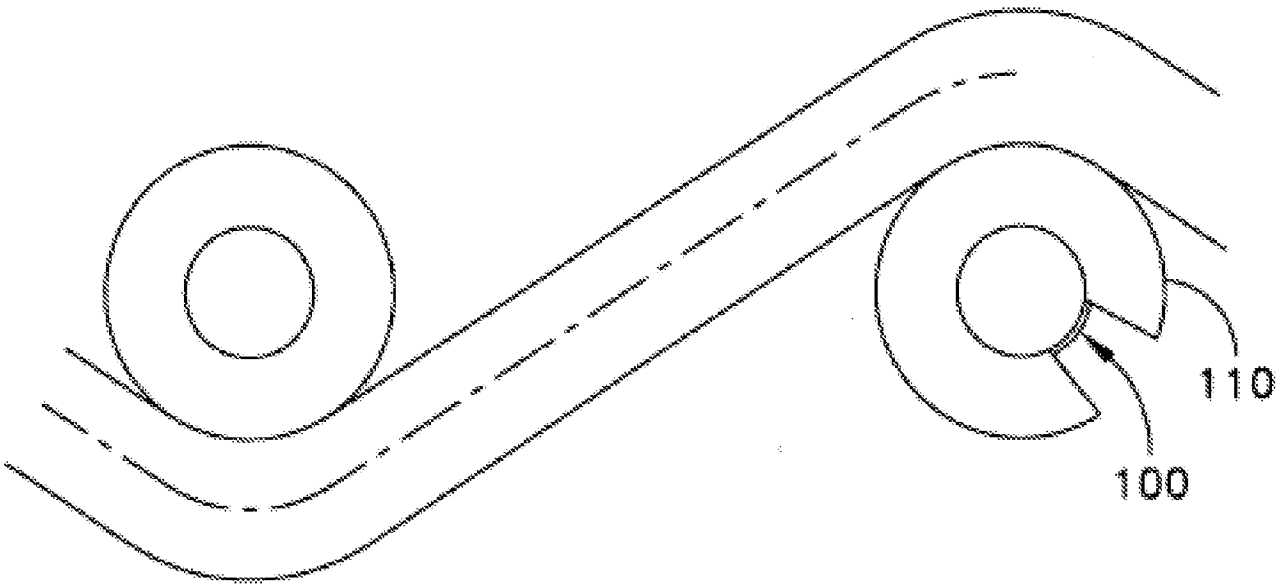
FIG. 20 depicts a woven layer with coated yarns.

As represented in FIG. 20, yarns 100 are pulled through a solution that substantially coats their surfaces such that a diameter with a coating 110 ensures the proper amount of crimp content in the fabric. The minimum recommended coating diameter should be two times the yarn diameter (or yarn thickness for non-circular cross section yarn). Such a coating thickness would be recognizable to one ordinarily skilled in the art when performing the inventive coating method.

Figure 21:
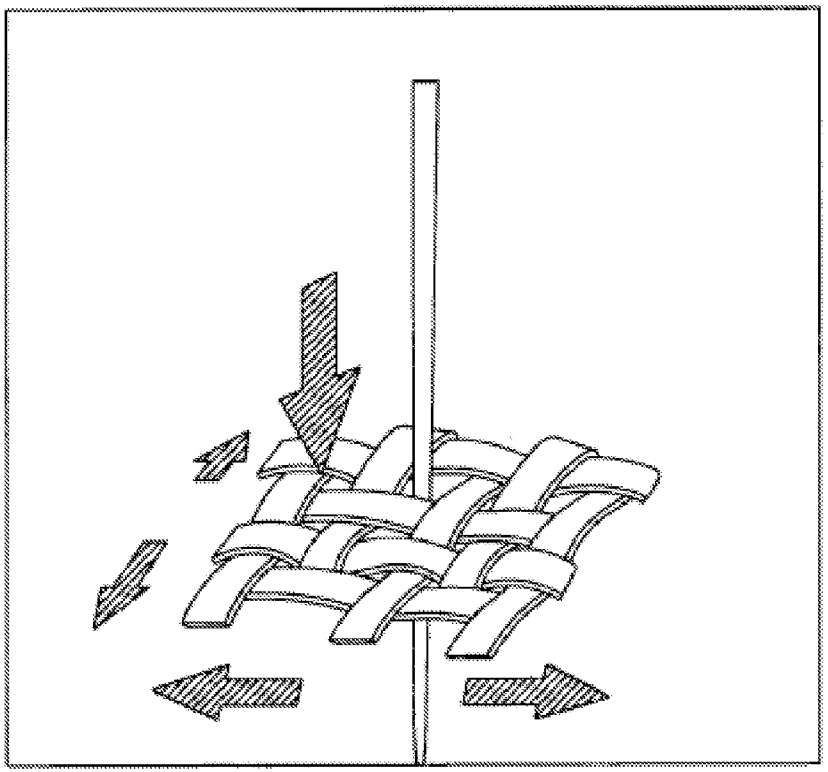
FIG. 21 (PRIOR ART)
FIG. 21 is a prior art depiction that ballistic grade fabric has few crossover points so that the fabric is pushed aside from all directions allowing penetration.
Figure 22:
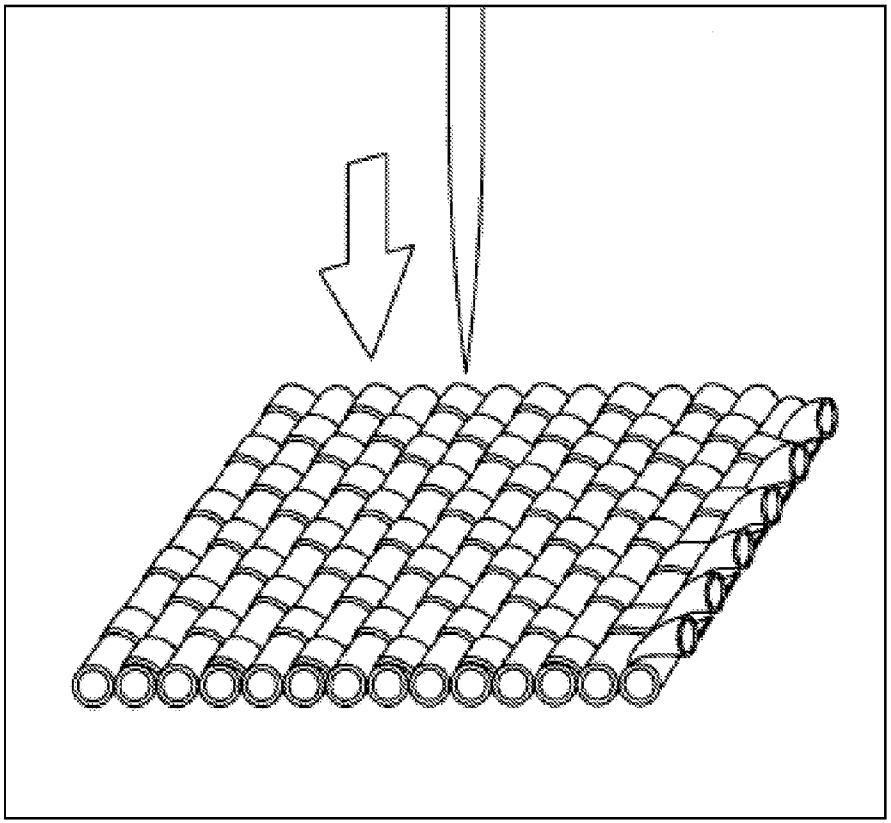
FIG. 22 (PRIOR ART)
FIG. 22 is a prior art depiction with tightly-woven armored fabric with increased crossover points.
Figure 23:
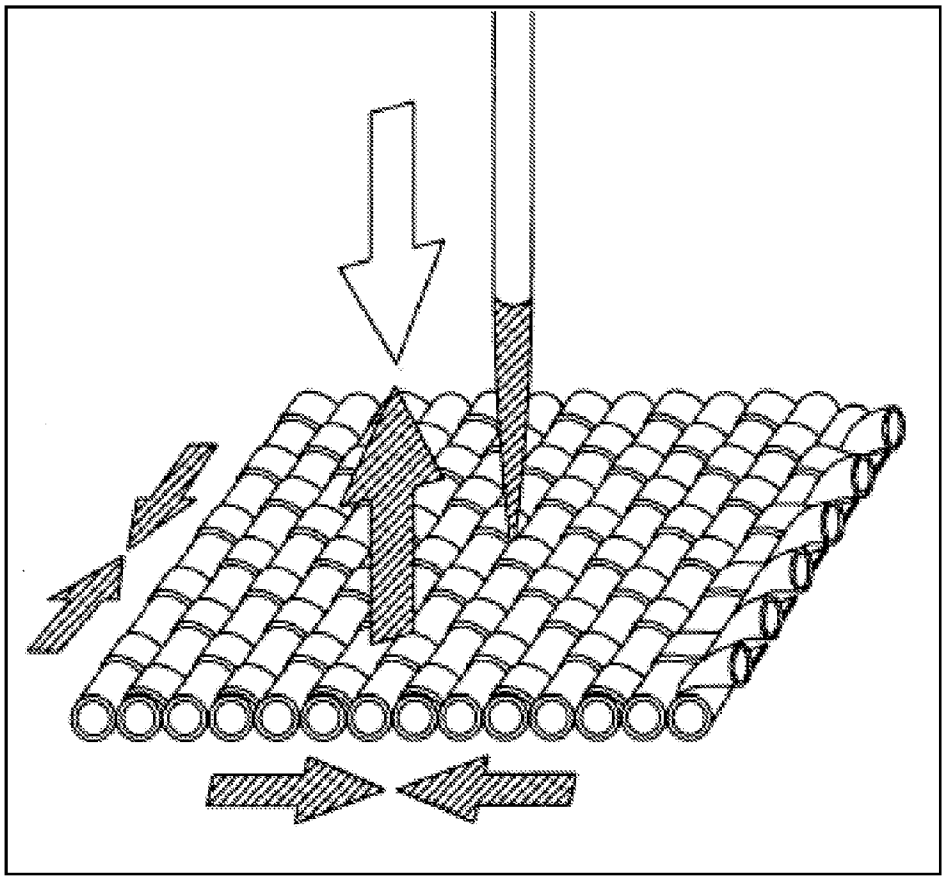
FIG. 23 (PRIOR ART)
FIG. 23 is a prior art depiction with stress from weapons point against tightly-woven fabric increases as force is applied.
Figure 24:
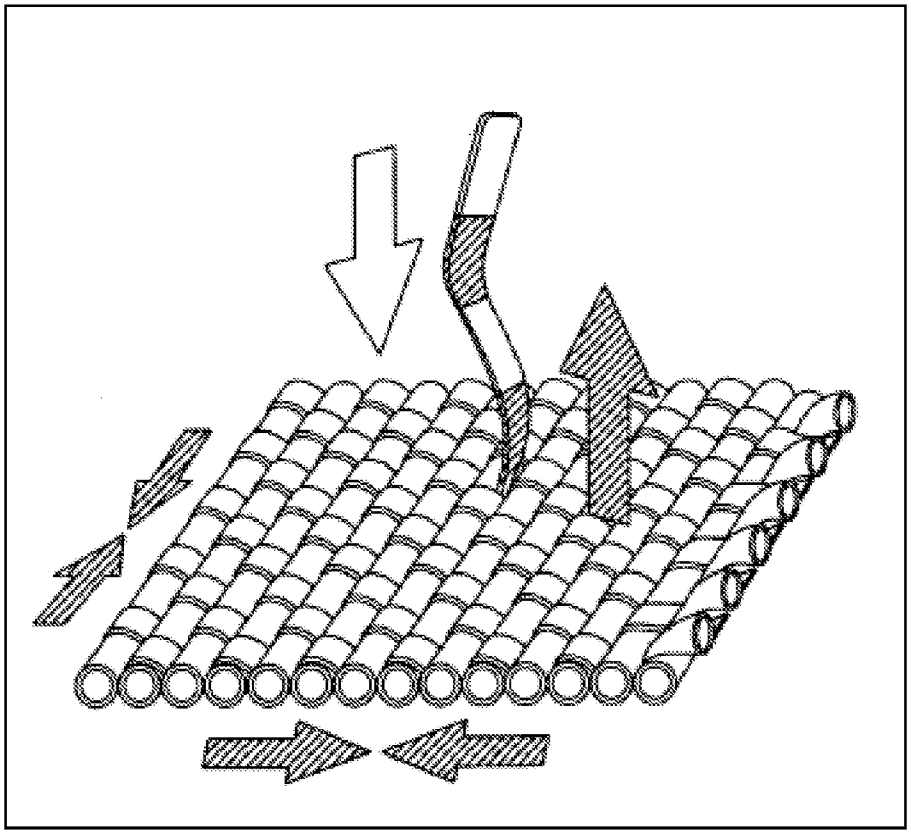
FIG. 24 (PRIOR ART)
FIG. 24 is a prior art depiction with fiber strength if fabric exceeds the weapons material strength as the weapons fails to penetrate and is damaged.

In FIGS. 21-24, prior art ballistic grade versus stab protection grade woven fabrics are shown. FIG. 21 depicts ballistic grade fabric having fewer crossover points so that the fabric is pushed aside from all directions allowing protection and FIG. 22 depicts tightly woven armed fabric with increased cross-over points. FIG. 23 depicts stress from a weapons point-of-view against tightly woven fabric increases as force is applied and FIG. 24 depicts fiber strength of fabric exceeding the weapons material strength—the weapon fails to penetrate and is damaged.

Returning to FIG. 20, the temporary and removable coating 110 enables the fabric to be constructed with excessive crimp contents beyond those achievable by controlling yarn tensions and weaving speeds. The coating 110, which can secure the yarn 100 in a positional state, can also "lock-in" the necessary yarn curvature.

Crimping of the yarns occurs when the yarns are woven into fabric form. Crimping is a direct consequence of the weaving process in which the yarns of one direction are placed in an alternating style over and under yarns of the crossing style. The amount of waviness in a yarn due to the over/under weaving is the amount of crimp content. Similar to the amplitude of a sine wave in which the greater the amplitude, the greater the crimp content. Each fabric layer in a multi-layer fabric armor system can be tailored to have different crimp contents for specific performance advantages of the fabric.

The temporary coating can instead be permanent because as the cover factor (when the yarn is used as soft fabric armor) increases so does penetration protection because the interstices between yarns decrease in size, which increases the resistance of the yarns to be pushed aside by sharp pointed penetrators. The more stabilized the crimping, the more that the yarns resist opening (expansion) of the existing interstices. Stabilized crimping will attempt to preserve the original (non-impacted) coverage (i.e., cover factor) of the fabric. However, the use of coatings to produce the desired crimp imbalance during the weaving process will only have an effect on penetration resistance of the fabric when they are not removed. In the case of the coating being temporary and removed, there can be no effect.

Figure 25:
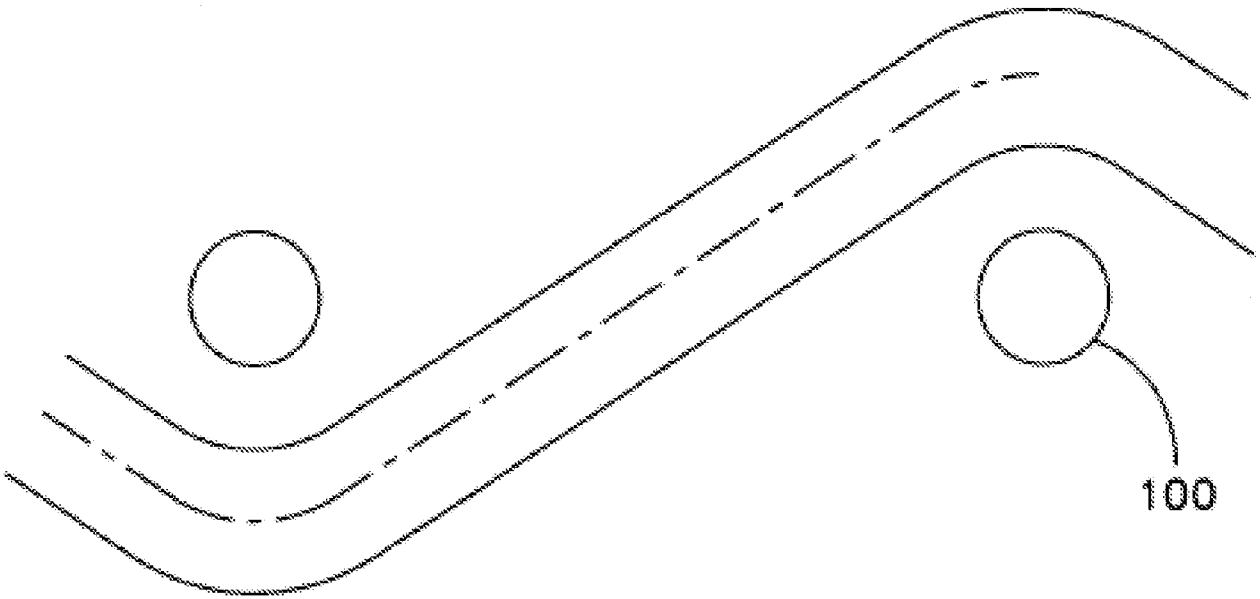
FIG. 25 depicts a woven layer with a temporary coating removed thereby providing relatively high crimp content.

If the cover factor is not a factor for consideration, the fabric is woven with the temporary coating intact and upon completion of the weaving process; the coating is then removed by solvent, temperature exposure or other suitable method. Removing the coating can be a follow-on element of the inventive approach (See FIG. 25).

A second alternative method for producing crimp-imbalanced fabrics is to twist a temporary yarn of a given diameter on to the Higher Crimp Content (HCC) yarn prior to weaving. Upon completion of the weaving process, this temporary yarn would be removed by through, high temperature exposure, solvent or other suitable method.

Crimp-imbalanced fabric layers can be employed with rigid armor systems used to protect vehicles, shelters and other military structures. Crimp-imbalanced fabric layers can be either embedded internally or mounted on the back face (i.e., a spall liner) of rigid armor systems such as RHA, matrix-reinforced composite and ceramic strike face-based armors. The HCC yarns: provide the rigid armor with an elastic, core-like, behavior that absorb additional energy; provide an enhanced blunting mechanism and alter the trajectory of the projectile by forcing tumbling. Furthermore, the HCC yarns may alter the trajectory path of any ensuing fragments while ensuring protection within the regions of oblique susceptibility as shown in FIG. 14.

Prior art involving fabric armor generally refers to "loose" (open) and "tight" (dense) weave constructions but does not quantify crimp contents in both yarn families. Weave density alone is not sufficient to characterize fabric construction. Crimp content must be quantified in addition to yarn counts per inch. Two woven fabrics constructed of the same warp and weft counts per inch have different ballistic protection performance levels (i.e., $V_{50}$) if the crimp contents of each yarn family are not identical. Furthermore, it is recommended that quality controls of fabric armor require specifications and measurements of crimp contents in each yarn family in addition to the yarn counts per inch.

Figure 26:
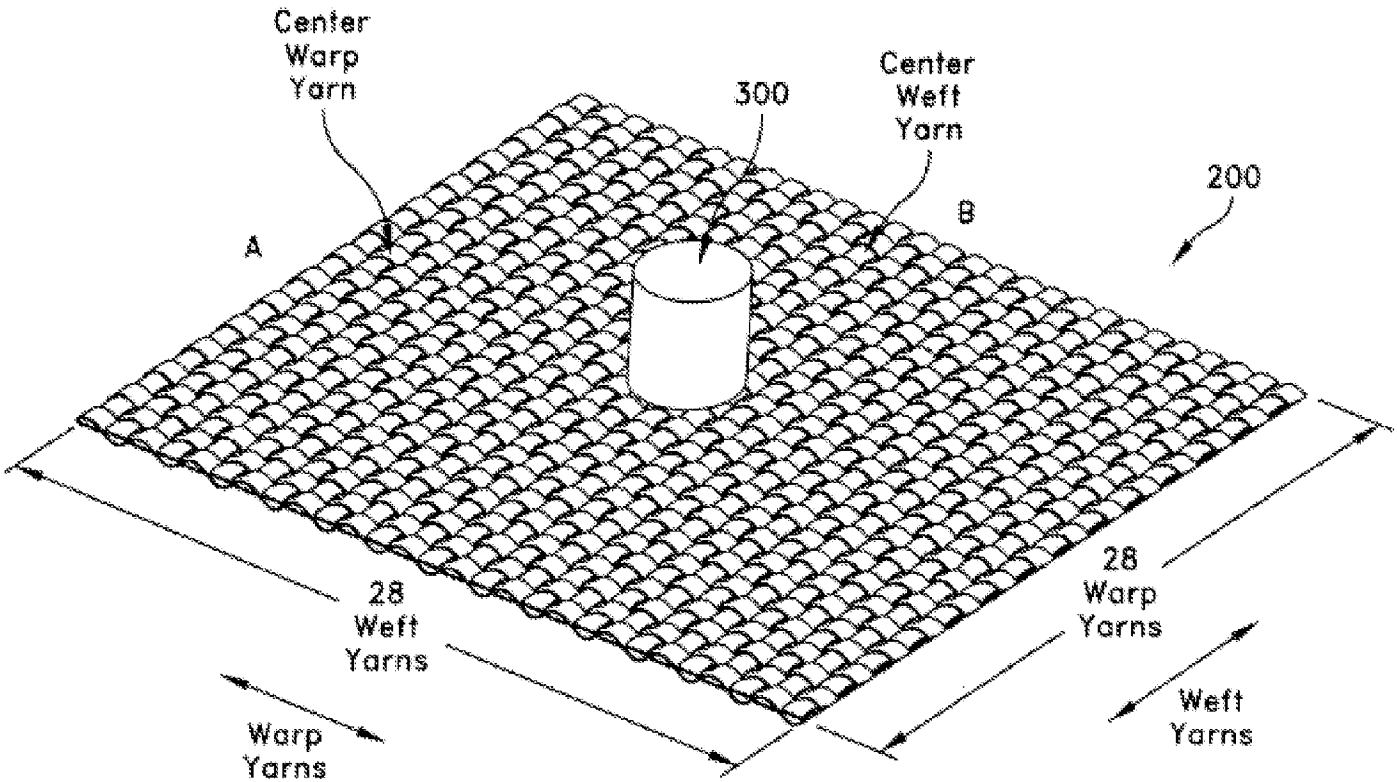
FIG. 26 depicts a weft×warp yarn fabric with a test rigid right cylinder positioned for impact.
Figure 27:
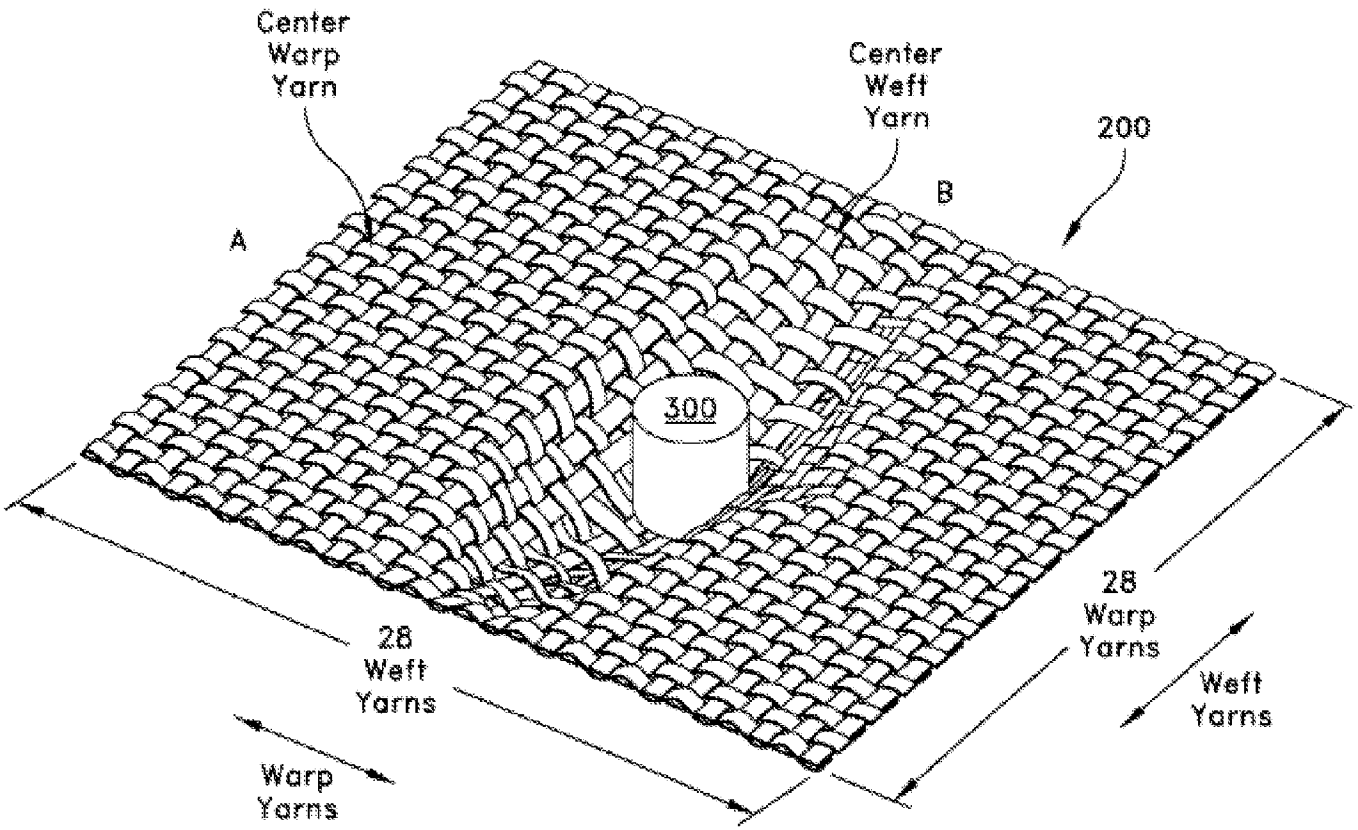
FIG. 27 depicts a weft×warp yarn fabric with an impacting test rigid right cylinder.
Figure 28:
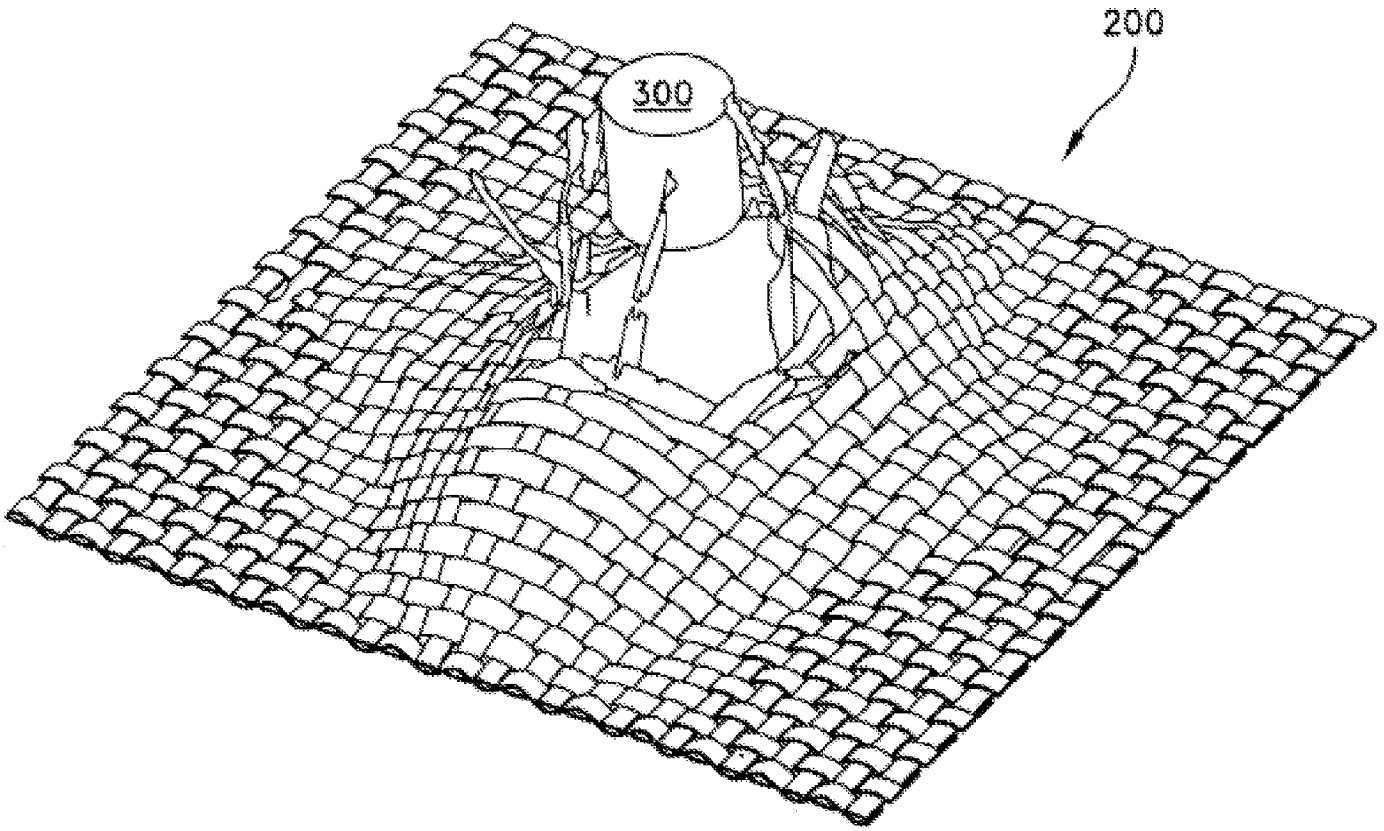
FIG. 28 depicts a weft×warp yarn fabric with tensile failure criteria activated by the impacting test rigid right cylinder.

The advantages of the present invention are depicted in FIGS. 26-32. An example use of fabric produced by the present invention is shown in FIG. 26. In the figure, a weft yarn×warp yarn fabric 200 is shown with a rigid right circular cylinder 300 positioned for impact. For measurement at Points "A" and "B", the points are at the center warp yarn and the center weft yarn. The "center" is an equi-distance point from the edges of the fabric 200. In FIG. 27, the impact of the circular cylinder 300 against the fabric 200 is shown. In FIG. 28, the cylinder 300 "breaking thru" the fabric 200 is shown with a 1800 feet-per-second (fps) velecity with tensile failure criteria activated.

Figure 29:
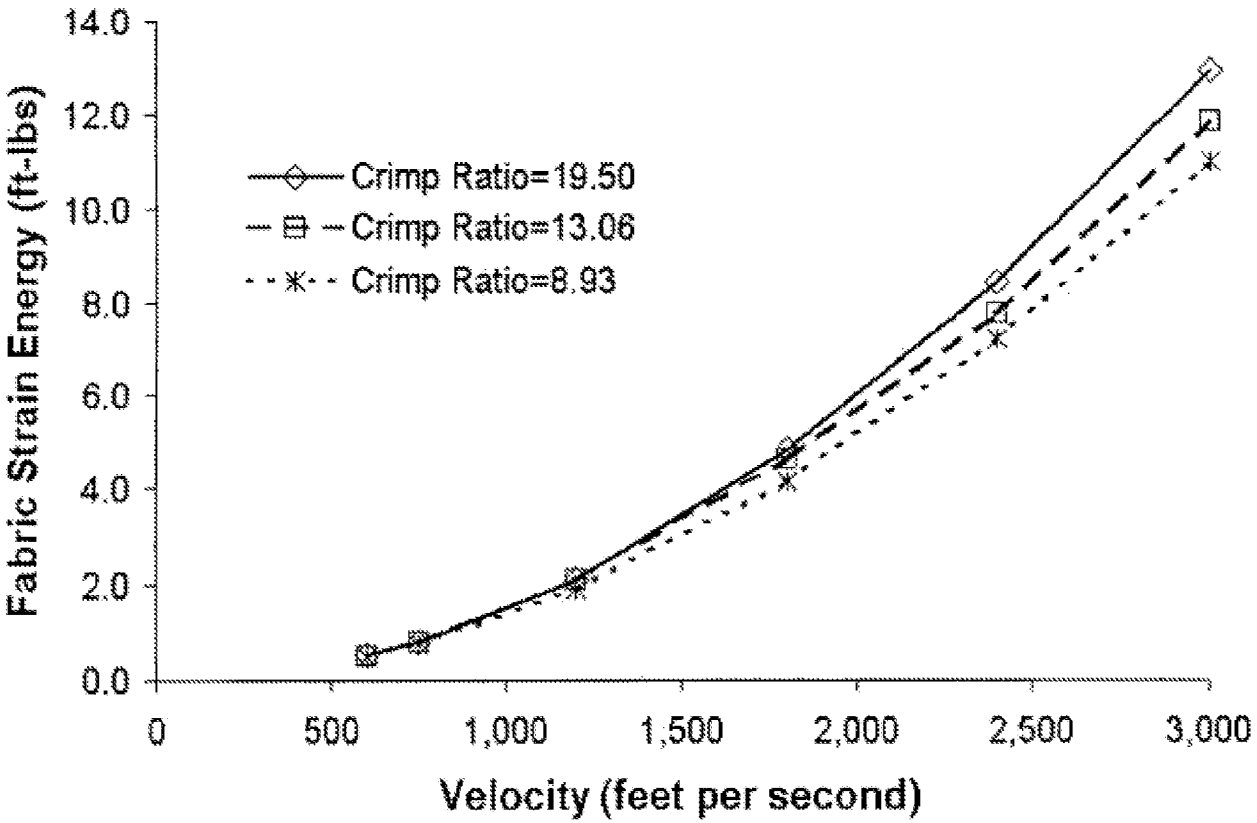
FIG. 29 is a graph of the relationship between velocity and fabric strain energy with the fabric produced by the present invention charted at a variety of crimp ratios.
Figure 30:
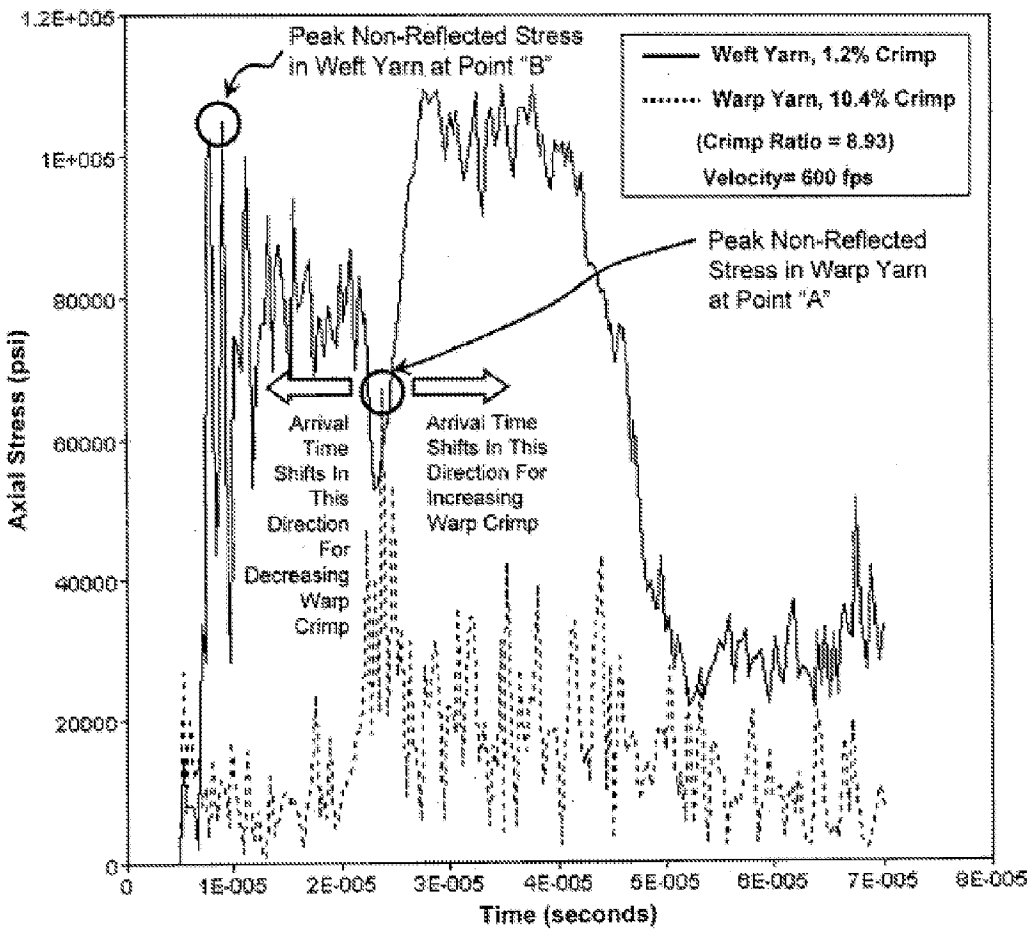
FIG. 30 depicts a relationship between the longitudinal axial (tensile) stress of the yarns of the fabric (produced by the method of the present invention) during a time period with a 1.2% crimp of the weft yarn and a 15.2% crimp of the warp yarn (crimp ratio=13.06)
Figure 31:
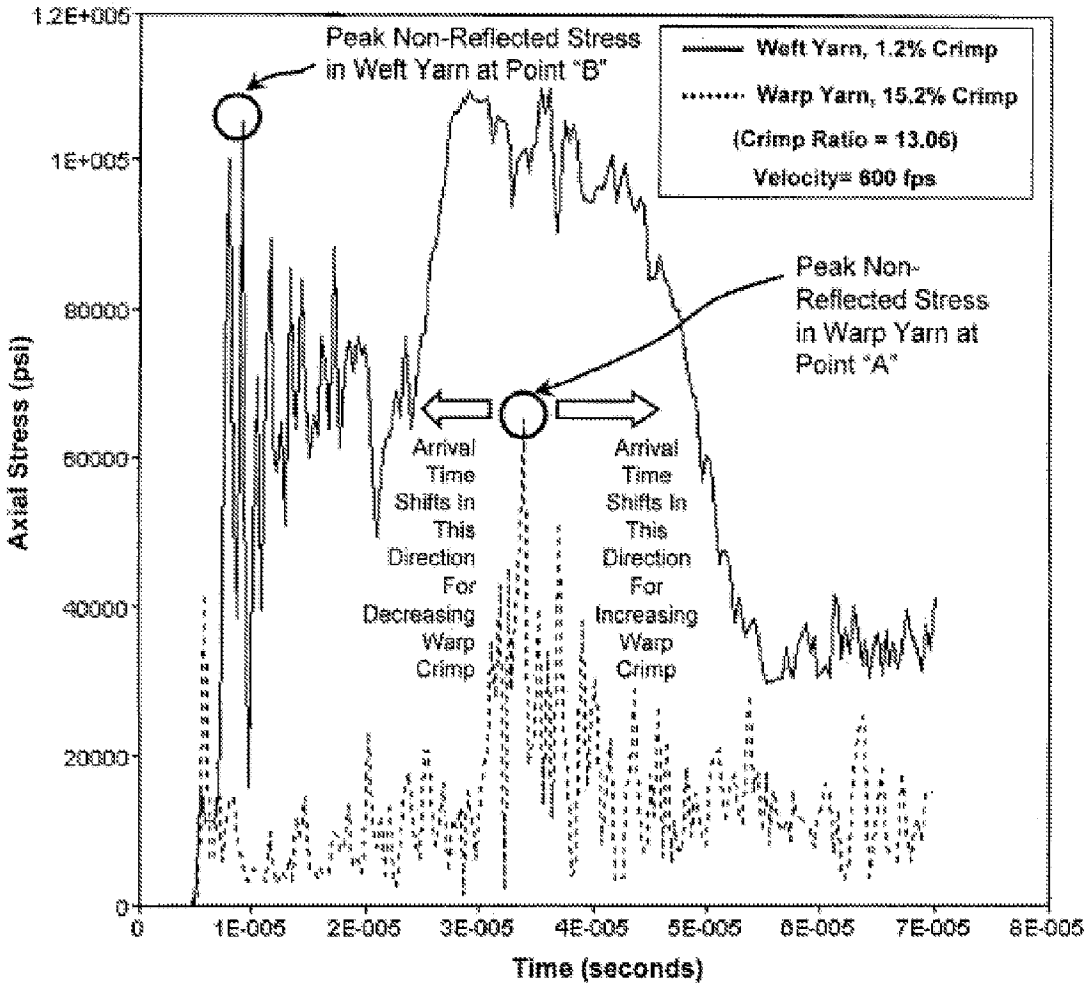
FIG. 31 depicts a relationship between the longitudinal axial (tensile) stress of the yarns of the fabric during a time period with a 1.2% crimp of the weft yarn and a 22.7% crimp of the warp yarn (crimp ratio=19.50)
Figure 32:
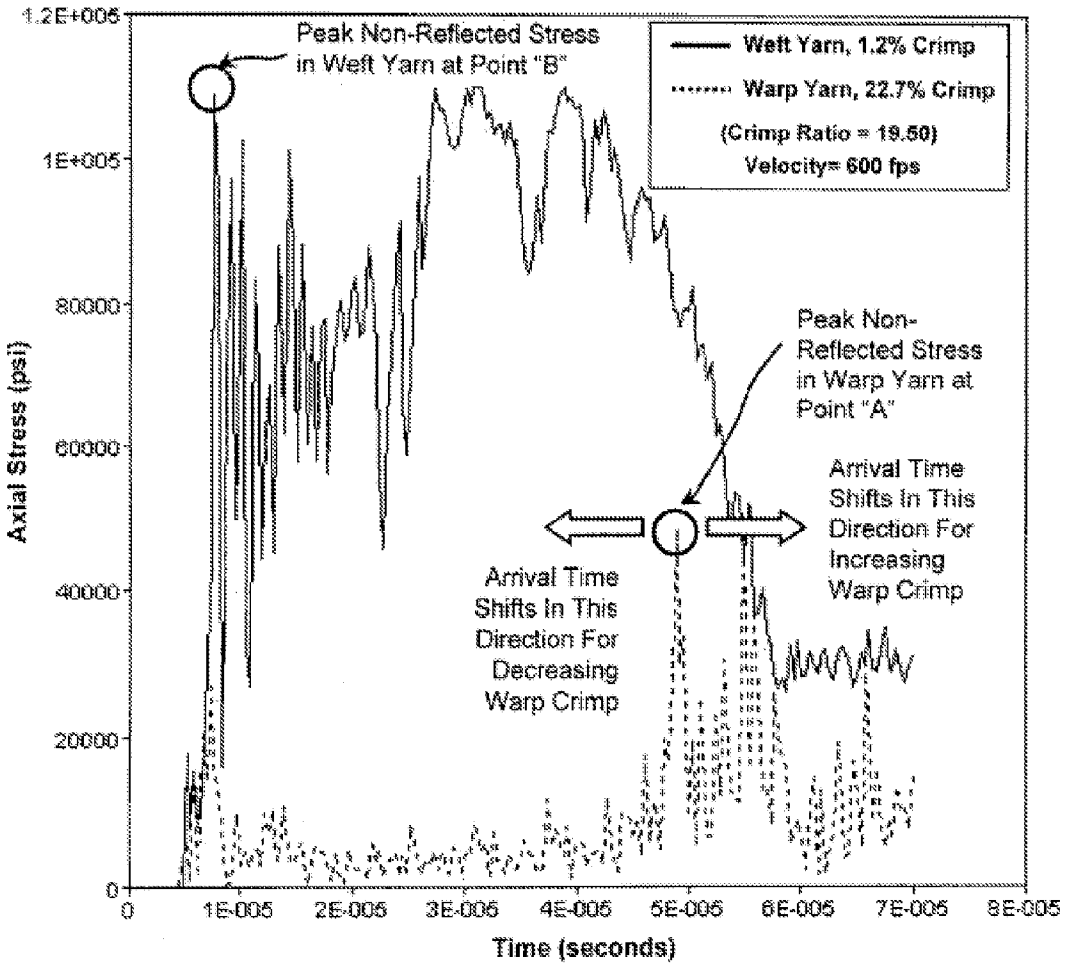
FIG. 32 depicts a relationship between the longitudinal axial (tensile) stress of the yarns of the fabric during a time period with a 1.2% crimp of the weft yarn and a 10.4% crimp of the warp yarn (crimp ratio=8.93)

In FIG. 29, a graph is depicted of the relationship between the velocity of the cylinder 300 and the strain energy of the fabric 200 produced by the method of the present invention charted at a variety of crimp ratios in which the weft crimp content is essentially constant. The crimp ratio is the percentage of crimp in the warp yarn divided by the percentage of crimp in the weft yarn. In FIG. 30-FIG. 32, graphs depict the relationship between the longitudinal axial (tensile) stress of the yarns of the fabric 200 during a time period with varying crimp percentages and crimp ratios. The crimp percentages are determinable by Equation (1).

Figure 33:
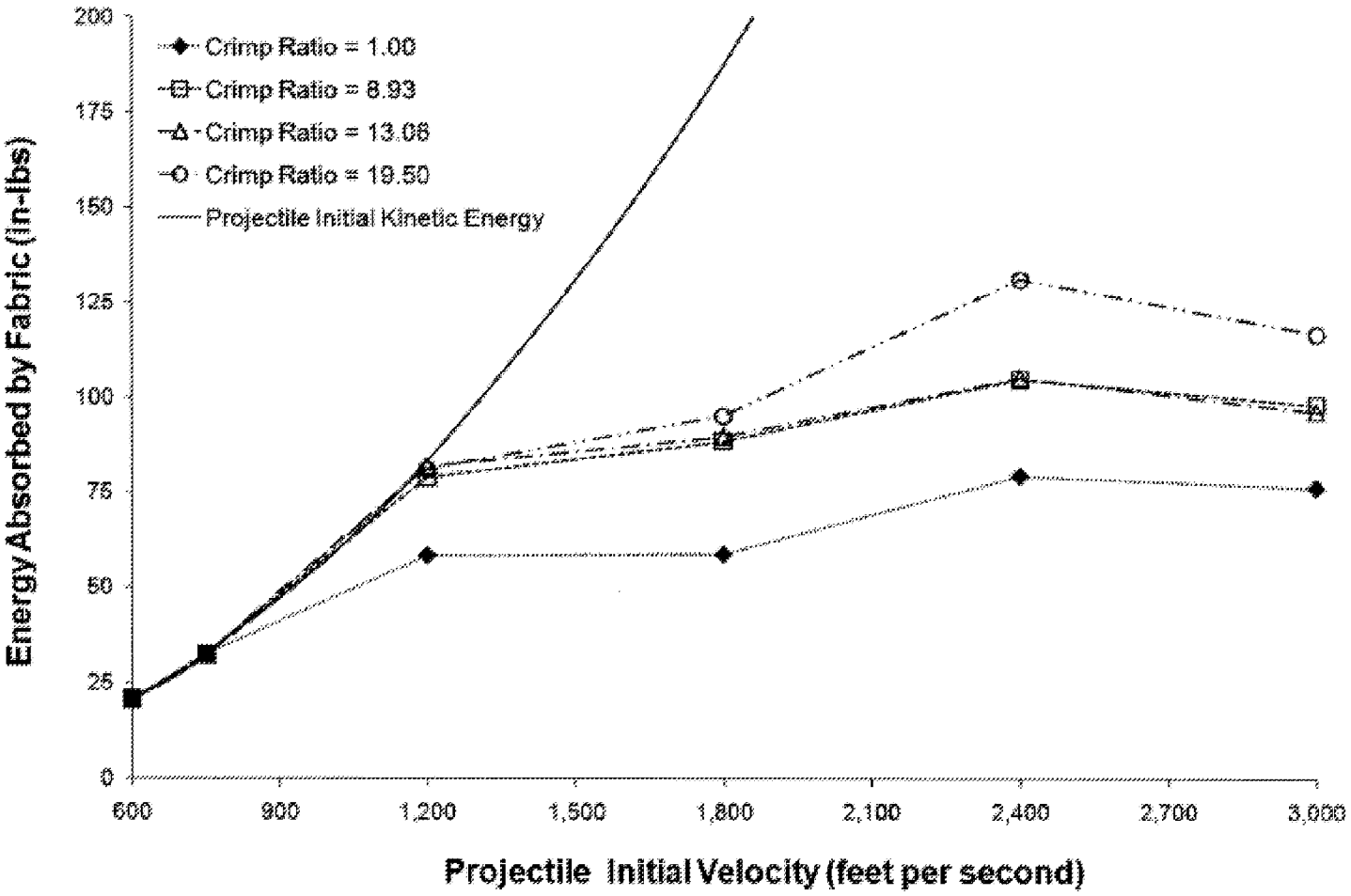
FIG. 33 is a graph of the relationship between initial projectile velocity and the energy absorbed by the fabric (conventionally referred to as a ballistic limit graph) for a two grain, rigid projectile impacting a single layer of a plain-woven fabric produced by the present invention and charted at a variety of crimp ratios (within a fixed 1.2% crimp of the weft yarns).

In FIG. 33, a graph is depicted of the relationship between the velocity of the cylinder 300 and the absorbed energy of the fabric 200 (produced by the method of the present invention) charted at a variety of crimp ratios in which the weft crimp content is essentially constant. The crimp ratio is the percentage of crimp in the warp yarn divided by the percentage of crimp in the weft yarn.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method for producing a multi-layer fabric, said method comprising the steps of:

providing a first set of yarns with a first and second amount of yarns;

coating separate yarns of the first amount of yarns with a removable coating with a first thickness such that a coating diameter of each of the separate yarns is at least two times a diameter of each of the separate yarns;

controlling tension in each yarn of the first amount of yarns;

weaving a first fabric layer in a plain weave architecture of balanced crimp contents with the first amount of yarns;

applying a first measured crimp by said weaving step in each yarn of the first amount of yarns wherein the thickness of the removable coating alters a crimp content of each yarn of the first amount of yarns when woven;

coating separate yarns of the second amount of yarns with a removable coating with a second thickness such that a coating diameter of each of the separate yarns is at least two times a diameter of each of the separate yarns of the second amount of yarns;

controlling tension in each yarn of the second amount of yarns;

weaving a second fabric layer with the second amount of yarns in a plain weave architecture with balanced crimp contents;

applying a second measured crimp in each yarn of the second amount of yarns by said step of weaving the second fabric layer wherein the thickness of the removable coating alters a crimp content of each yarn of the second amount of yarns when woven; and combining the first fabric layer and the second fabric layer such that a face of each layer contacts the face of another layer in a planer contact.

2. The method in accordance with claim 1, said method further comprising a step of removing the coating from the first set of yarns.

3. The method in accordance with claim 1, said method further comprising a step of interposing a third layer in planar contact and between the first and second layers with the third layer comprising ceramic materials.

4. The method in accordance with claim 3, said method further comprising a step of removing the coating from the first set of yarns.

* * * * *